US010854939B2

(12) United States Patent
Ashida et al.

(10) Patent No.: US 10,854,939 B2
(45) Date of Patent: Dec. 1, 2020

(54) DIELECTRIC FILTER

(71) Applicant: TDK CORPORATION, Tokyo (JP)

(72) Inventors: Yuta Ashida, Tokyo (JP); Noriyuki Hirabayashi, Tokyo (JP); Shigemitsu Tomaki, Tokyo (JP)

(73) Assignee: TDK CORPORATION, Tokyo (JP)

( * ) Notice: Subject to any disclaimer, the term of this patent is extended or adjusted under 35 U.S.C. 154(b) by 95 days.

(21) Appl. No.: 16/223,272

(22) Filed: Dec. 18, 2018

(65) Prior Publication Data

US 2019/0237838 A1 Aug. 1, 2019

(30) Foreign Application Priority Data

Jan. 31, 2018 (JP) ..... 2018-015687

(51) Int. Cl.

| | |
|---|---|
| ***H01P 1/20*** | (2006.01) |
| ***H01P 11/00*** | (2006.01) |
| ***H01P 7/10*** | (2006.01) |
| ***H01P 1/18*** | (2006.01) |
| ***H01P 1/208*** | (2006.01) |

(52) U.S. Cl.

CPC ..... *H01P 1/2002* (2013.01); *H01P 1/182* (2013.01); *H01P 1/2084* (2013.01); *H01P 7/10* (2013.01); *H01P 11/007* (2013.01)

(58) Field of Classification Search

CPC ..... H01P 1/2084; H01P 1/2086; H01P 1/208; H01P 1/2002; H01P 1/182; H01P 7/10; H01P 7/105

USPC ..... 333/202, 24 C

See application file for complete search history.

(56) References Cited

U.S. PATENT DOCUMENTS

2014/0152403 A1* 6/2014 Park ..... H03H 7/0115 333/202
2016/0072169 A1* 3/2016 Lin ..... H01P 1/2084 333/202
2018/0191045 A1* 7/2018 Zhang ..... G01R 33/32

FOREIGN PATENT DOCUMENTS

CN 103718375 A 4/2014
JP 2000-013107 A 1/2000

OTHER PUBLICATIONS

Translation of Aug. 28, 2020 Office Action issued in Chinese Patent Application No. 201910085238.1.

* cited by examiner

*Primary Examiner* — Stephen E. Jones
(74) *Attorney, Agent, or Firm* — Oliff PLC

(57) ABSTRACT

A dielectric filter has a first input/output port, a second input/output port, an even number of dielectric resonators, and a capacitor for capacitively coupling the first input/output port and the second input/output port. The even number of dielectric resonators are provided between the first input/output port and the second input/output port in circuit configuration, and are configured so that two dielectric resonators adjacent to each other in circuit configuration are magnetically coupled to each other.

8 Claims, 28 Drawing Sheets

DIELECTRIC FILTER

BACKGROUND OF THE INVENTION

1. Field of the Invention

The present invention relates to a dielectric filter including a plurality of dielectric resonators.

2. Description of the Related Art

The standardization of fifth-generation mobile communication systems (hereinafter referred to as 5G) is currently ongoing. For 5G, the use of frequency bands of 10 GHz or higher, particularly a quasi-millimeter wave band of 10 to 30 GHz and a millimeter wave band of 30 to 300 GHz, is being studied to expand the frequency band.

Among electronic components for use in communication apparatuses are band-pass filters each including a plurality of resonators. Dielectric filters each including a plurality of dielectric resonators are promising as band-pass filters usable in the frequency bands of 10 GHz or higher.

One of favorable characteristics of the band-pass filters is a steep change in insertion loss in at least one of two frequency regions, i.e., a first passband-neighboring region and a second passband-neighboring region, the first passband-neighboring region being a frequency region close to the passband and lower than the passband, the second passband-neighboring region being a frequency region close to the passband and higher than the passband. Such a characteristic can be achieved by, for example, generating an attenuation pole in at least one of the first and second passband-neighboring regions in the frequency response of the insertion loss.

For a band-pass filter that includes three or more resonators configured so that two resonators adjacent to each other in circuit configuration are electromagnetically coupled to each other, one method for generating one or more attenuation poles in the frequency response of the insertion loss is to establish electromagnetic coupling between two resonators that are not adjacent to each other in circuit configuration.

JP2000-013107A describes a technique for generating one or more attenuation poles in the frequency response of the insertion loss of a dielectric filter that includes a plurality of dielectric blocks configured so that two dielectric blocks adjacent to each other in circuit configuration are electromagnetically coupled to each other. According to the technique, the one or more attenuation poles are generated by electromagnetically coupling two dielectric blocks that are not adjacent to each other in circuit configuration.

Conventionally, in a dielectric filter including a plurality of dielectric resonators, some structural contrivance is needed for providing electromagnetic coupling between tow dielectric resonators that are not adjacent to each other in circuit configuration. Disadvantageously, this has resulted in increase in complexity of the structure of the dielectric filter.

SUMMARY OF THE INVENTION

It is an object of the present invention to provide a dielectric filter that is able to provide two attenuation poles in the frequency response of the insertion loss while being simple in structure.

A dielectric filter of the present invention includes a first input/output port, a second input/output port, an even number of dielectric resonators, and a capacitor for capacitively coupling the first input/output port and the second input/output port. The even number of dielectric resonators are provided between the first input/output port and the second input/output port in circuit configuration, and are configured so that two dielectric resonators adjacent to each other in circuit configuration are magnetically coupled to each other.

In the dielectric filter of the present invention, the even number of dielectric resonators may include a first input/output stage resonator which is closest to the first input/output port in circuit configuration, and a second input/output stage resonator which is closest to the second input/output port in circuit configuration. In such a case, the dielectric filter may further include a first phase shifter provided between the first input/output port and the first input/output stage resonator in circuit configuration, and a second phase shifter provided between the second input/output port and the second input/output stage resonator in circuit configuration.

The first phase shifter may be configured to be capacitively coupled to the first input/output stage resonator, and the second phase shifter may be configured to be capacitively coupled to the second input/output stage resonator.

The dielectric filter of the present invention may further include a structure for constructing the even number of dielectric resonators and the capacitor. The structure may include an even number of resonator body portions corresponding to the even number of dielectric resonators, and a peripheral dielectric portion lying around the even number of resonator body portions. Each of the even number of resonator body portions is formed of a first dielectric having a first relative permittivity. The peripheral dielectric portion is formed of a second dielectric having a second relative permittivity lower than the first relative permittivity.

The structure may further include a shield portion formed of a conductor. The shield portion lies around the even number of resonator body portions such that at least part of the peripheral dielectric portion is interposed between the shield portion and the even number of resonator body portions. In such a case, each of the even number of resonator body portions may be in non-contact with the shield portion.

The structure may include a separation conductor layer formed of a conductor and separating an area where the even number of resonator body portions lie from an area where the capacitor lies.

When the dielectric filter includes the structure mentioned above, the even number of dielectric resonators may include: a first input/output stage resonator which is closest to the first input/output port in circuit configuration; a second input/output stage resonator which is closest to the second input/output port in circuit configuration; and two or more intermediate resonators lying between the first input/output stage resonator and the second input/output stage resonator in circuit configuration. In such a case, the even number of resonator body portions may include: a first input/output stage resonator body portion corresponding to the first input/output stage resonator; a second input/output stage resonator body portion corresponding to the second input/output stage resonator; and two or more intermediate resonator body portions corresponding to the two or more intermediate resonators. The first input/output stage resonator body portion and the second input/output stage resonator body portion may be physically adjacent to each other with none of the two or more intermediate resonator body portions interposed therebetween. The structure may further include a partition that is formed of a conductor and arranged to pass between the first and second input/output stage resonator body portions.

The dielectric filter of the present invention is able to provide two attenuation poles in the frequency response of the insertion loss while being simple in structure.

Other and further objects, features and advantages of the invention will appear more fully from the following description.

DETAILED DESCRIPTION OF THE PREFERRED EMBODIMENTS

First Embodiment

Figure 1:
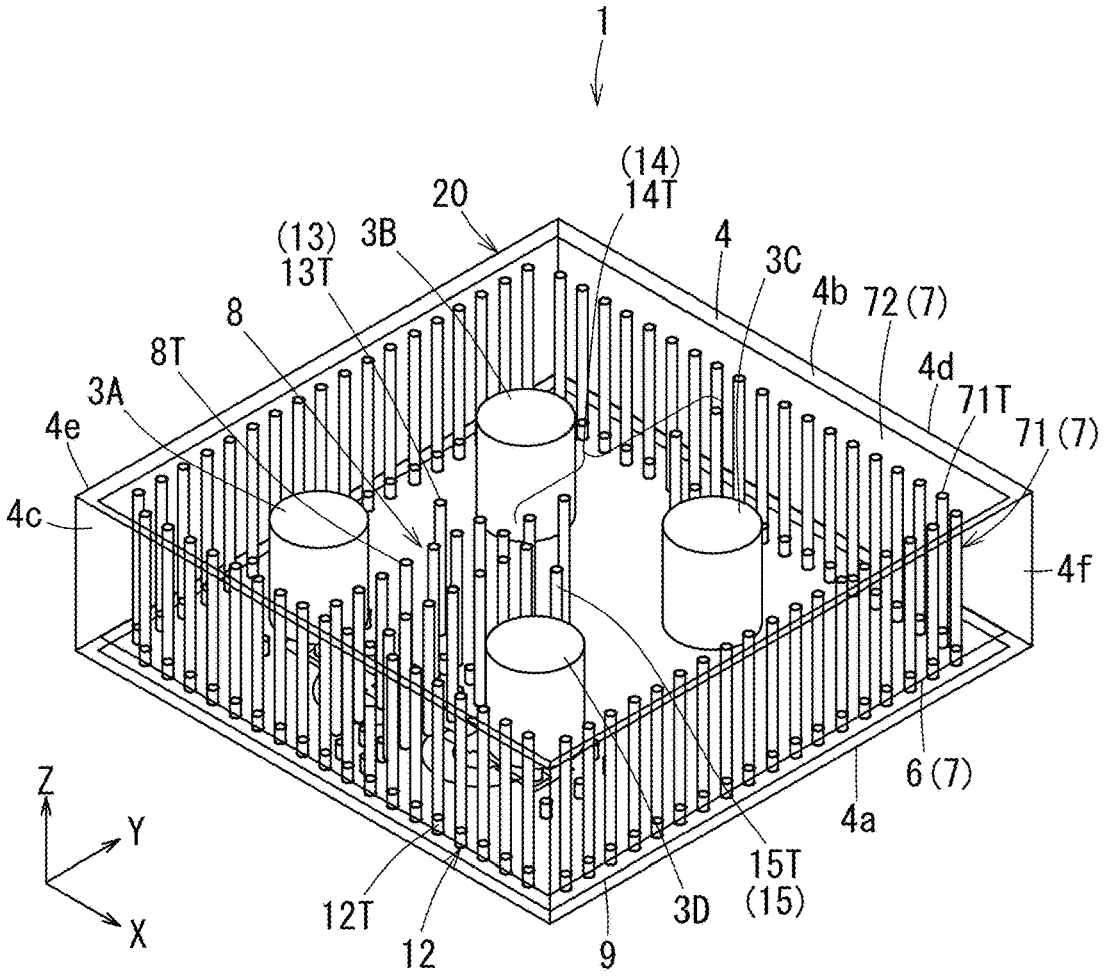
FIG. 1 is a perspective view illustrating the interior of a dielectric filter according to a first embodiment of the invention.
Figure 2:
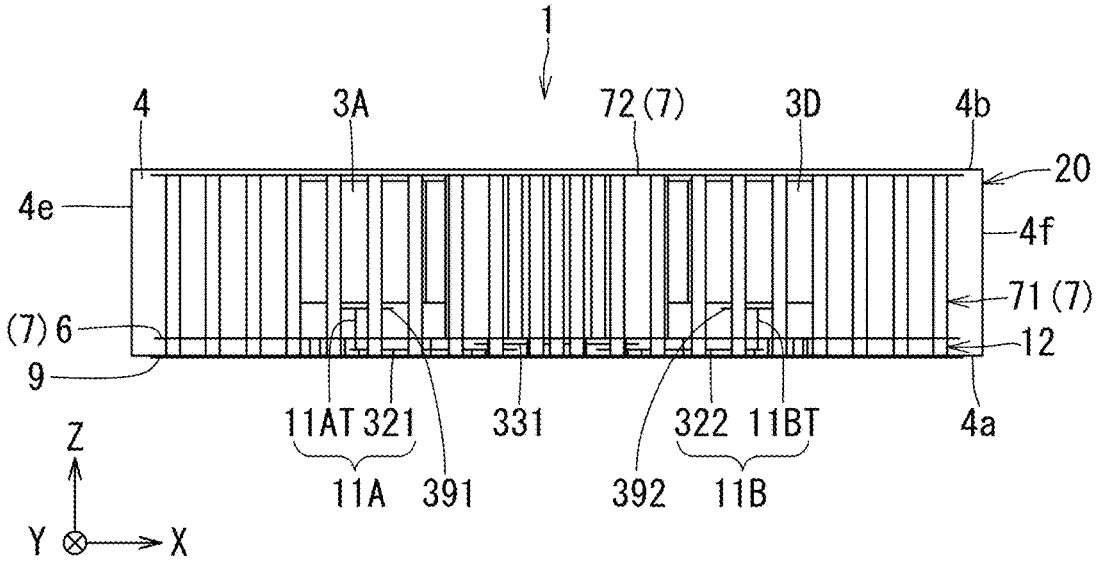
FIG. 2 is a side view illustrating the interior of the dielectric filter according to the first embodiment of the invention.
Figure 3:
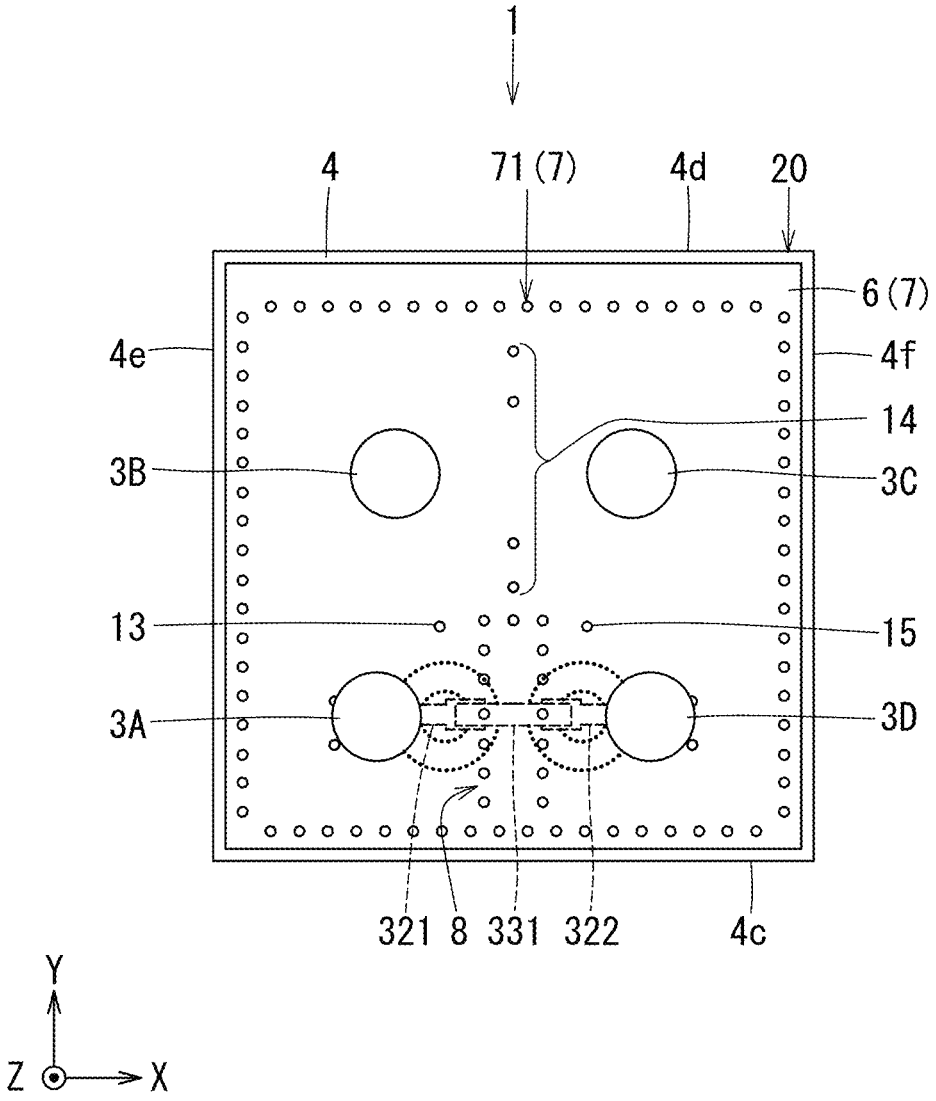
FIG. 3 is a plan view illustrating the interior of the dielectric filter according to the first embodiment of the invention.
Figure 4:
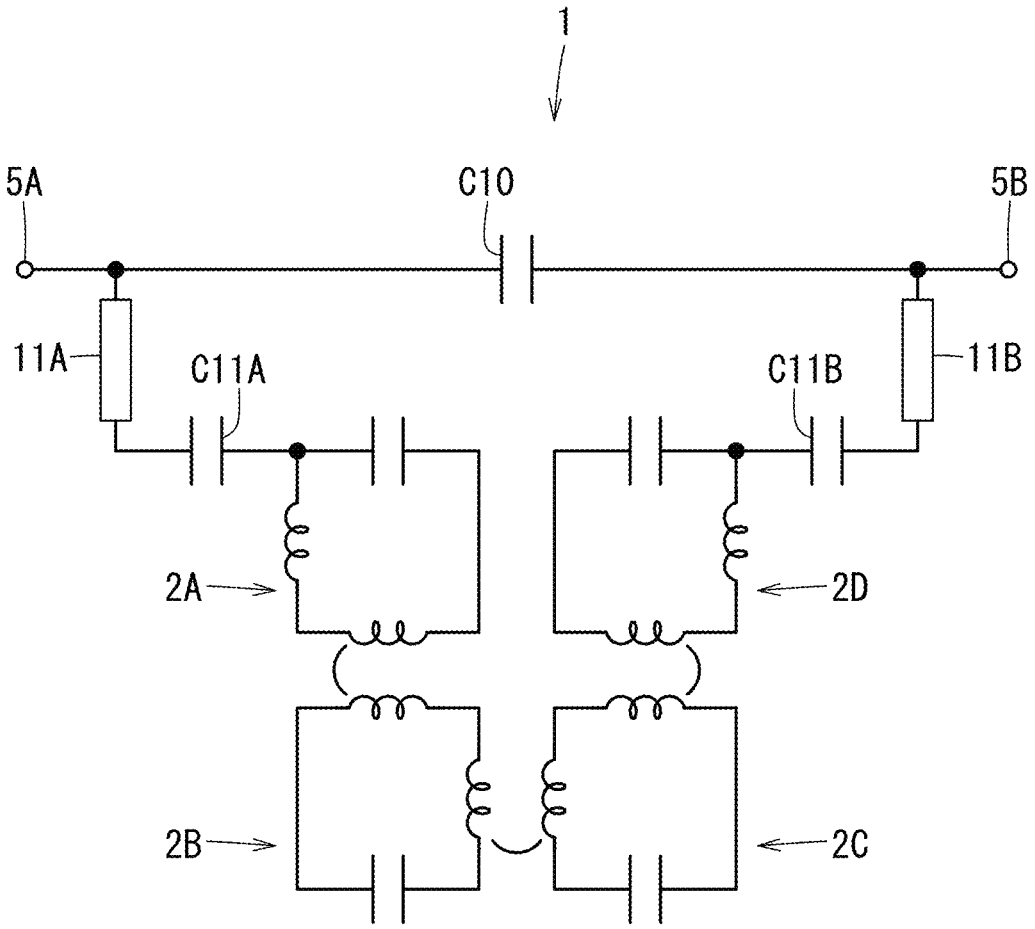
FIG. 4 is a circuit diagram illustrating an equivalent circuit of the dielectric filter according to the first embodiment of the invention.

Preferred embodiments of the present invention will now be described in detail with reference to the drawings. First, reference is made to FIG. 1 to FIG. 4 to describe the configuration of a dielectric filter according to a first embodiment of the invention. FIG. 1 is a perspective view illustrating the interior of the dielectric filter according to the present embodiment. FIG. 2 is a side view illustrating the interior of the dielectric filter according to the present embodiment. FIG. 3 is a plan view illustrating the interior of the dielectric filter according to the present embodiment. FIG. 4 is a circuit diagram illustrating an equivalent circuit of the dielectric filter according to the present embodiment.

The dielectric filter 1 according to the present embodiment has a band-pass filter function. As shown in FIG. 4, the dielectric filter 1 includes a first input/output port 5A, a second input/output port 5B, an even number of dielectric resonators, and a capacitor C10 for capacitively coupling the first input/output port 5A and the second input/output port 5B.

The capacitor C10 is provided between the first input/output port 5A and the second input/output port 5B, and has a first end connected to the first input/output port 5A and a second end connected to the second input/output port 5B.

The even number of dielectric resonators are provided between the first input/output port 5A and the second input/output port 5B in circuit configuration, and are configured so that two dielectric resonators adjacent to each other in circuit configuration are magnetically coupled to each other. As used herein, the phrase "in circuit configuration" is to describe layout in a circuit diagram, not in a physical configuration.

The present embodiment presents an example in which the dielectric filter 1 includes four dielectric resonators 2A, 2B, 2C, and 2D, as shown in FIG. 4. The dielectric resonators 2A, 2B, 2C, and 2D are arranged in this order, from closest to farthest, from the first input/output port 5A in circuit configuration. The dielectric resonators 2A, 2B, 2C, and 2D are configured so that: the dielectric resonators 2A and 2B are adjacent to each other in circuit configuration and are magnetically coupled to each other; the dielectric resonators 2B and 2C are adjacent to each other in circuit configuration and are magnetically coupled to each other; and the dielectric resonators 2C and 2D are adjacent to each other in circuit configuration and are magnetically coupled to each other. Each of the dielectric resonators 2A, 2B, 2C, and 2D has an inductance and a capacitance.

Hereinafter, the dielectric resonator 2A which is closest to the first input/output port 5A in circuit configuration will also be referred to as the first input/output stage resonator 2A, and the dielectric resonator 2D which is closest to the second input/output port 5B in circuit configuration will also be referred to as the second input/output stage resonator 2D. The other two dielectric resonators 2B and 2C lying between the first and second input/output stage resonators 2A and 2D in circuit configuration will also be referred to as the intermediate resonators 2B and 2C.

As shown in FIG. 4, the dielectric filter 1 further includes a first phase shifter 11A and a second phase shifter 11B. Each of the first and second phase shifters 11A and 11B causes a change in the phase of a signal passing therethrough. The amount of the change in the phase caused by each of the first and second phase shifters 11A and 11B will hereinafter be referred to as a phase change amount.

The first phase shifter 11A is provided between the first input/output port 5A and the first input/output stage resonator 2A in circuit configuration. The first phase shifter 11A is configured to be capacitively coupled to the first input/output stage resonator 2A. In FIG. 4, the capacitor symbol C11A represents the capacitive coupling between the first phase shifter 11A and the first input/output stage resonator 2A.

The second phase shifter 11B is provided between the second input/output port 5B and the second input/output stage resonator 2D in circuit configuration. The second phase shifter 11B is configured to be capacitively coupled to the second input/output stage resonator 2D. In FIG. 4, the capacitor symbol C11B represents the capacitive coupling between the second phase shifter 11B and the second input/output stage resonator 2D.

As shown in FIG. 1 to FIG. 3, the dielectric filter 1 includes a structure 20 for constructing the first and second input/output ports 5A and 5B, the dielectric resonators 2A, 2B, 2C and 2D, the capacitor C10 and the first and second phase shifters 11A and 11B.

The structure 20 includes an even number of resonator body portions corresponding to the even number of dielectric resonators, and a peripheral dielectric portion 4 lying around the even number of resonator body portions. Each of the even number of resonator body portions is formed of a first dielectric having a first relative permittivity. The peripheral dielectric portion 4 is formed of a second dielectric having a second relative permittivity lower than the first relative permittivity. In the present embodiment, specifically, the structure 20 includes four resonator body portions 3A, 3B, 3C, and 3D corresponding to the four dielectric resonators 2A, 2B, 2C, and 2D, respectively.

Hereinafter, the resonator body portion 3A corresponding to the first input/output stage resonator 2A will also be referred to as the first input/output stage resonator body portion 3A, and the resonator body portion 3D corresponding to the second input/output stage resonator 2D will also be referred to as the second input/output stage resonator body portion 3D. The resonator body portions 3B and 3C corresponding to the intermediate resonators 2B and 2C will also be referred to as the intermediate resonator body portions 3B and 3C.

In the present embodiment, the peripheral dielectric portion 4 is formed of a multilayer stack of a plurality of dielectric layers. Now, we define X, Y and Z directions as shown in FIG. 1 to FIG. 3. As shown, the X, Y and Z directions are orthogonal to each other. In the present embodiment, the plurality of dielectric layers are stacked in the Z direction (the upward direction in FIG. 1).

The peripheral dielectric portion 4 is in the shape of a rectangular solid and has an external surface. The external surface of the peripheral dielectric portion 4 includes a top surface 4*b* and a bottom surface 4*a* opposite to each other in the Z direction, and four side surfaces 4*c*, 4*d*, 4*e* and 4*f* connecting the top surface 4*b* and the bottom surface 4*a*. The side surfaces 4*c* and 4*d* are opposite to each other in the Y direction. The side surfaces 4*e* and 4*f* are opposite to each other in the X direction.

In the example shown in FIG. 1, each of the resonator body portions 3A to 3D has a cylindrical shape with a central axis in the Z direction. However, the shape of each of the resonator body portions 3A to 3D is not limited to a cylindrical shape, and may be, for example, a quadrangular prism shape. Each of the resonator body portions 3A to 3D may be formed of a collection of a plurality of rod-like members each formed of the first dielectric.

The resonator body portions 3A to 3D are configured so that the resonator body portions 3A and 3B are magnetically coupled to each other, the resonator body portions 3B and 3C are magnetically coupled to each other, and the resonator body portions 3C and 3D are magnetically coupled to each other.

As shown in FIG. 1, the structure 20 further includes a separation conductor layer 6 and a shield portion 7 each formed of a conductor.

The separation conductor layer 6 separates an area where the resonator body portions 3A to 3D lie from an area where the capacitor C10 lies.

The shield portion 7 lies around the resonator body portions 3A to 3D such that at least part of the peripheral dielectric portion 4 is interposed between the shield portion 7 and the resonator body portions 3A to 3D.

In the present embodiment, the separation conductor layer 6 also serves as part of the shield portion 7. The shield portion 7 includes the separation conductor layer 6, a shield conductor layer 72, and a connection portion 71. FIG. 3 omits the illustration of the shield conductor layer 72.

The separation conductor layer 6 and the shield conductor layer 72 are spaced apart from each other in the Z direction inside the peripheral dielectric portion 4. The separation conductor layer 6 lies near the bottom surface 4*a* of the peripheral dielectric portion 4. The shield conductor layer 72 lies near the top surface 4*b* of the peripheral dielectric portion 4. The resonator body portions 3A to 3D lie in the area between the separation conductor layer 6 and the shield conductor layer 72 within the structure 20. Each of the resonator body portions 3A to 3D has a top end face closest to the shield conductor layer 72 and a bottom end face closest to the separation conductor layer 6. The connection portion 71 electrically connects the separation conductor layer 6 and the shield conductor layer 72. The connection portion 71 includes a plurality of through hole lines 71T. Each of the plurality of through hole lines 71T includes two or more through holes connected in series. The separation conductor layer 6, the shield conductor layer 72 and the connection portion 71 are arranged to surround the resonator body portions 3A to 3D. Each of the resonator body portions 3A to 3D is in non-contact with the shield portion 7.

As shown in FIGS. 1 and 3, the first input/output stage resonator body portion 3A and the second input/output stage resonator body portion 3D are physically adjacent to each other with neither of the intermediate resonator body portions 3B and 3C interposed therebetween. The resonator body portions 3A and 3D are aligned in the X direction near the side surface 4*c* of the peripheral dielectric portion 4. The resonator body portions 3B and 3C are aligned in the X direction near the side surface 4*d* of the peripheral dielectric portion 4.

As shown in FIG. 1, the structure 20 further includes a partition 8, a ground layer 9, and a connection portion 12 each formed of a conductor.

The partition 8 is intended to prevent the occurrence of magnetic coupling between the first input/output stage resonator body portion 3A and the second input/output stage resonator body portion 3D. The partition 8 is arranged to pass between the first input/output stage resonator body portion 3A and the second input/output stage resonator body portion 3D. The partition 8 electrically connects the separation conductor layer 6 and the shield conductor layer 72. The partition 8 includes a plurality of through hole lines 8T. Each of the plurality of through hole lines 8T includes two or more through holes connected in series.

The ground layer 9 is disposed on the bottom surface 4*a* of the peripheral dielectric portion 4. The connection portion 12 electrically connects the ground layer 9 and the separation conductor layer 6. The connection portion 12 includes a plurality of through hole lines 12T. Each of the plurality of through hole lines 12T includes two or more through holes connected in series.

The ground layer 9, the separation conductor layer 6 and the shield conductor layer 72 are all rectangular in shape as viewed in the Z direction.

As shown in FIG. 1, the structure 20 further includes coupling adjustment portions 13, 14 and 15 each formed of a conductor.

The coupling adjustment portion 13 is intended to adjust the magnitude of the magnetic coupling between the resonator body portions 3A and 3B. The coupling adjustment portion 14 is intended to adjust the magnitude of the magnetic coupling between the resonator body portions 3B and 3C. The coupling adjustment portion 15 is intended to adjust the magnitude of the magnetic coupling between the resonator body portions 3C and 3D. Each of the coupling adjustment portions 13, 14 and 15 electrically connects the separation conductor layer 6 and the shield conductor layer 72.

In the example shown in FIG. 1, the coupling adjustment portion 13 includes a single through hole line 13T. The coupling adjustment portion 14 includes a plurality of through hole lines 14T. The coupling adjustment portion 15 includes a single through hole line 15T. Each of the through hole lines 13T, 14T and 15T includes two or more through holes connected in series.

The dielectric resonator 2A is composed of the resonator body portion 3A, at least part of the peripheral dielectric portion 4, and the shield portion 7. The dielectric resonator 2B is composed of the resonator body portion 3B, at least part of the peripheral dielectric portion 4, and the shield portion 7. The dielectric resonator 2C is composed of the resonator body portion 3C, at least part of the peripheral dielectric portion 4, and the shield portion 7. The dielectric resonator 2D is composed of the resonator body portion 3D, at least part of the peripheral dielectric portion 4, and the shield portion 7. In the present embodiment, the resonance mode of each of the dielectric resonators 2A to 2D is a TM mode. An electromagnetic field generated by the dielectric resonators 2A to 2D is present inside and outside the resonator body portions 3A to 3D. The shield portion 7 has a function of confining the electromagnetic field outside the resonator body portions 3A to 3D to within the area surrounded by the shield portion 7.

Reference is now made to FIGS. 5 to 13 to describe an example of the plurality of dielectric layers constituting the peripheral dielectric portion 4 and an example of the configurations of a plurality of conductor layers formed on the dielectric layers and a plurality of through holes formed in the dielectric layers. In this example, the peripheral dielectric portion 4 has thirty-two dielectric layers stacked together. The thirty-two dielectric layers will hereinafter be referred to as the first to thirty-second dielectric layers, respectively, in the order from bottom to top. The first to thirty-second dielectric layers will be denoted by the reference numerals 31 to 62, respectively. In FIGS. 5 to 12, each small circle represents a through hole.

Figure 5:
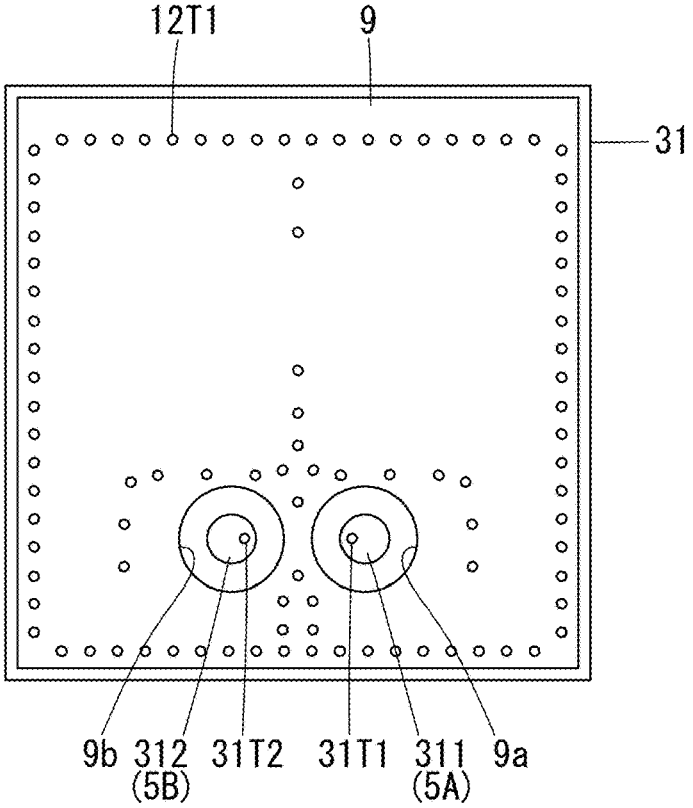
FIG. 5 is a plan view illustrating a patterned surface of a first dielectric layer of a peripheral dielectric portion shown in FIG. 1.

FIG. 5 illustrates a patterned surface of the first dielectric layer 31. On the patterned surface of the dielectric layer 31, there are formed the ground layer 9, a conductor layer 311 forming the first input/output port 5A, and a conductor layer 312 forming the second input/output port 5B. Two circular holes 9*a* and 9*b* are formed in the ground layer 9. The conductor layer 311 lies inside the hole 9*a*, and the conductor layer 312 lies inside the hole 9*b*.

Further, a through hole 31T1 connected to the conductor layer 311, and a through hole 31T2 connected to the conductor layer 312 are formed in the dielectric layer 31. Further formed in the dielectric layer 31 are a plurality of through holes 12T1 constituting respective portions of the plurality of through hole lines 12T. All the through holes in FIG. 5 except the through holes 31T1 and 31T2 are the through holes 12T1. The through holes 12T1 are connected to the ground layer 9.

Figure 6:
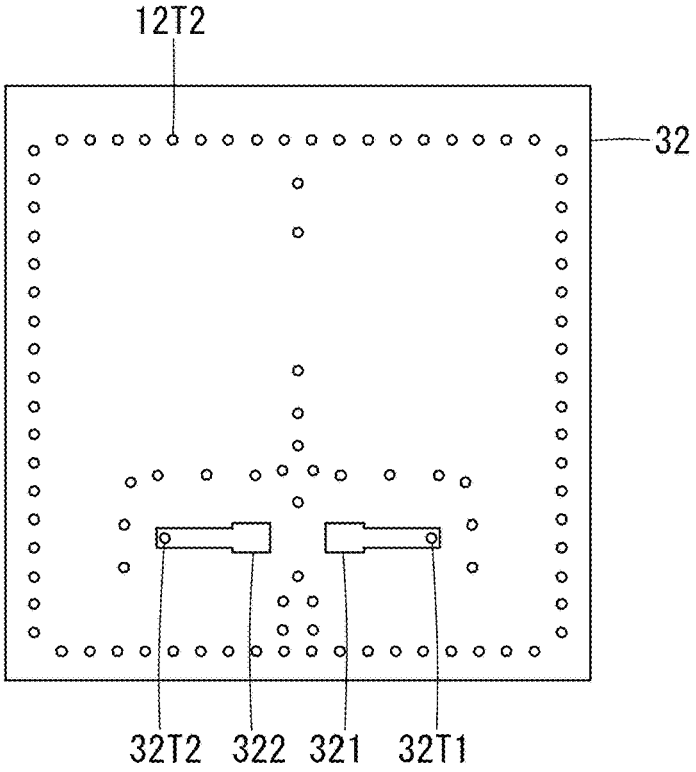
FIG. 6 is a plan view illustrating a patterned surface of a second dielectric layer of the peripheral dielectric portion shown in FIG. 1.

FIG. 6 illustrates a patterned surface of the second dielectric layer 32. On the patterned surface of the dielectric layer 32, there are formed conductor layers 321 and 322 which are long in the X direction. Each of the conductor layers 321 and 322 has a first end and a second end opposite to each other. The first end of the conductor layer 321 is opposed to the first end of the conductor layer 322. The through hole 31T1 shown in FIG. 5 is connected to a portion of the conductor layer 321 near the first end thereof. The through hole 31T2 shown in FIG. 5 is connected to a portion of the conductor layer 322 near the first end thereof.

Further formed in the dielectric layer 32 are a through hole 32T1 connected to a portion of the conductor layer 321 near the second end thereof, and a through hole 32T2 connected to a portion of the conductor layer 322 near the second end thereof. Further formed in the dielectric layer 32 are a plurality of through holes 12T2 constituting respective portions of the plurality of through hole lines 12T. All the through holes in FIG. 6 except the through holes 32T1 and 32T2 are the through holes 12T2. The through holes 12T1 shown in FIG. 5 are respectively connected to the through holes 12T2.

Figure 7:
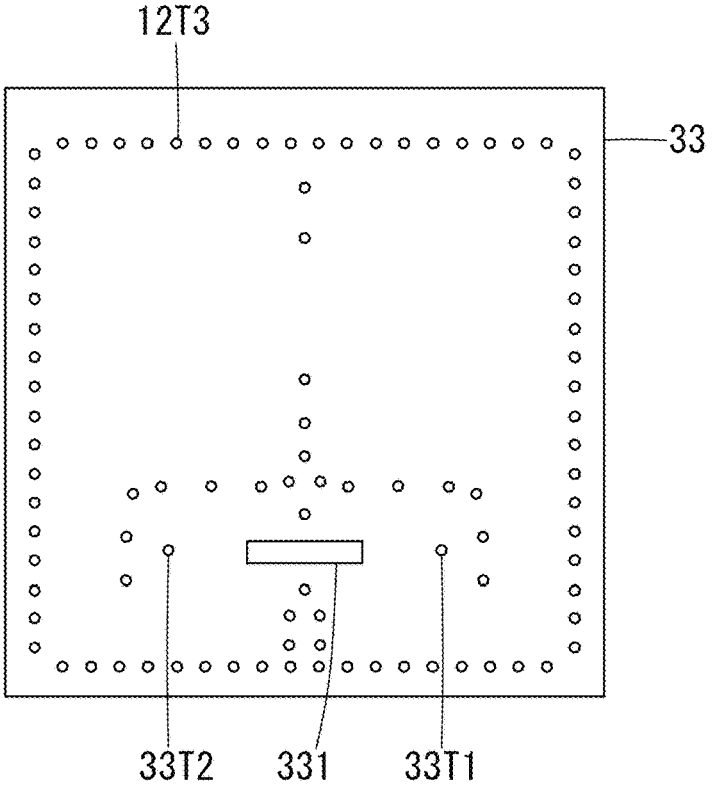
FIG. 7 is a plan view illustrating a patterned surface of a third dielectric layer of the peripheral dielectric portion shown in FIG. 1.

FIG. 7 illustrates a patterned surface of the third dielectric layer 33. A conductor layer 331 long in the X direction is formed on the patterned surface of the dielectric layer 33. A portion of the conductor layer 331 is opposed to the portion of the conductor layer 321 near the first end thereof with the dielectric layer 32 interposed therebetween. Another portion of the conductor layer 331 is opposed to the portion of the conductor layer 322 near the first end thereof with the dielectric layer 32 interposed therebetween.

Further formed in the dielectric layer 33 are through holes 33T1 and 33T2, and through holes 12T3 constituting respective portions of the through hole lines 12T. The through holes 32T1 and 32T2 shown in FIG. 6 are connected to the through holes 33T1 and 33T2, respectively. All the through holes in FIG. 7 except the through holes 33T1 and 33T2 are the through holes 12T3. The through holes 12T2 shown in FIG. 6 are respectively connected to the through holes 12T3.

Figure 8:
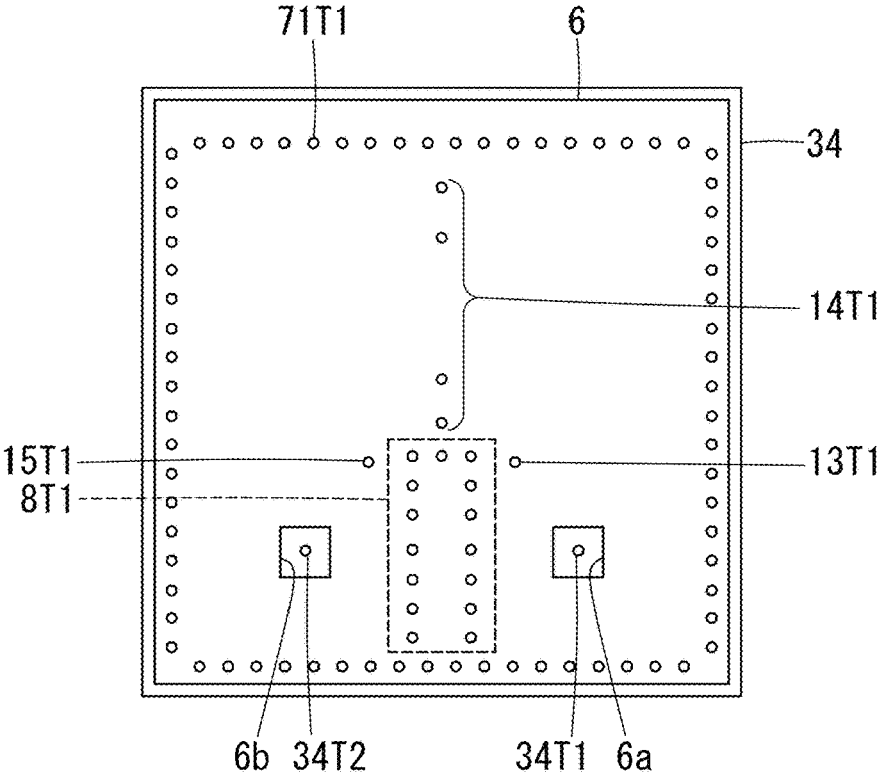
FIG. 8 is a plan view illustrating a patterned surface of a fourth dielectric layer of the peripheral dielectric portion shown in FIG. 1.

FIG. 8 illustrates a patterned surface of the fourth dielectric layer 34. The separation conductor layer 6 is formed on the patterned surface of the dielectric layer 34. Two rectangular holes 6*a* and 6*b* are formed in the separation conductor layer 6.

Through holes 34T1 and 34T2 are formed in the dielectric layer 34. Further formed in the dielectric layer 34 are through holes 8T1, 13T1, 14T1, 15T1, and 71T1 constituting respective portions of the through hole lines 8T, 13T, 14T, 15T, and 71T. All the through holes in FIG. 8 except the through holes 34T1, 34T2, 8T1, 13T1, 14T1 and 15T1 are the through holes 71T1.

The through hole 34T1 lies inside the hole 6*a*, and the through hole 34T2 lies inside the hole 6*b*. The through holes 33T1 and 33T2 shown in FIG. 7 are connected to the through holes 34T1 and 34T2, respectively.

In FIG. 8, all the through holes except the through holes 34T1 and 34T2 are connected to the separation conductor layer 6. The separation conductor layer 6 has a rectangular perimeter. The through holes 71T1 are connected to the separation conductor layer 6 at its areas near the perimeter.

Figure 9:
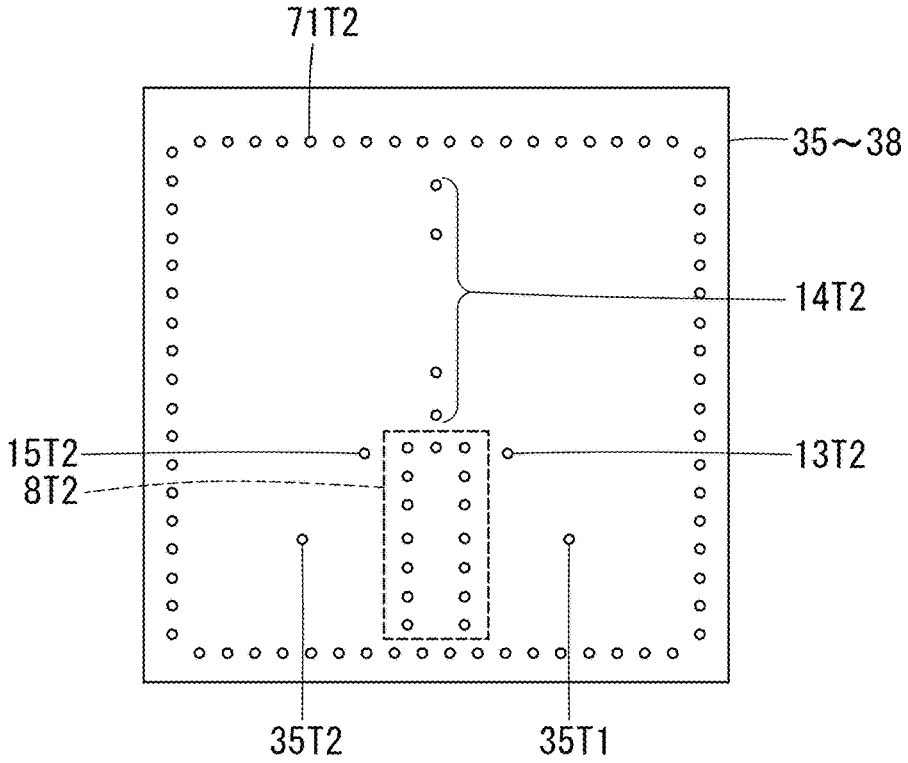
FIG. 9 is a plan view illustrating a patterned surface of each of a fifth to an eighth dielectric layer of the peripheral dielectric portion shown in FIG. 1.

FIG. 9 illustrates a patterned surface of each of the fifth to eighth dielectric layers 35 to 38. Through holes 35T1 and 35T2 are formed in each of the dielectric layers 35 to 38. Further formed in each of the dielectric layers 35 to 38 are through holes 8T2, 13T2, 14T2, 15T2, and 71T2 constituting respective portions of the through hole lines 8T, 13T, 14T, 15T, and 71T. All the through holes in FIG. 9 except the through holes 35T1, 35T2, 8T2, 13T2, 14T2 and 15T2 are the through holes 71T2.

The through holes 34T1, 34T2, 8T1, 13T1, 14T1, 15T1, and 71T1 shown in FIG. 8 are respectively connected to the through holes 35T1, 35T2, 8T2, 13T2, 14T2, 15T2, and 71T2 formed in the fifth dielectric layer 35. In the dielectric layers 35 to 38, every vertically adjacent through holes denoted by the same reference signs are connected to each other.

Figure 10:
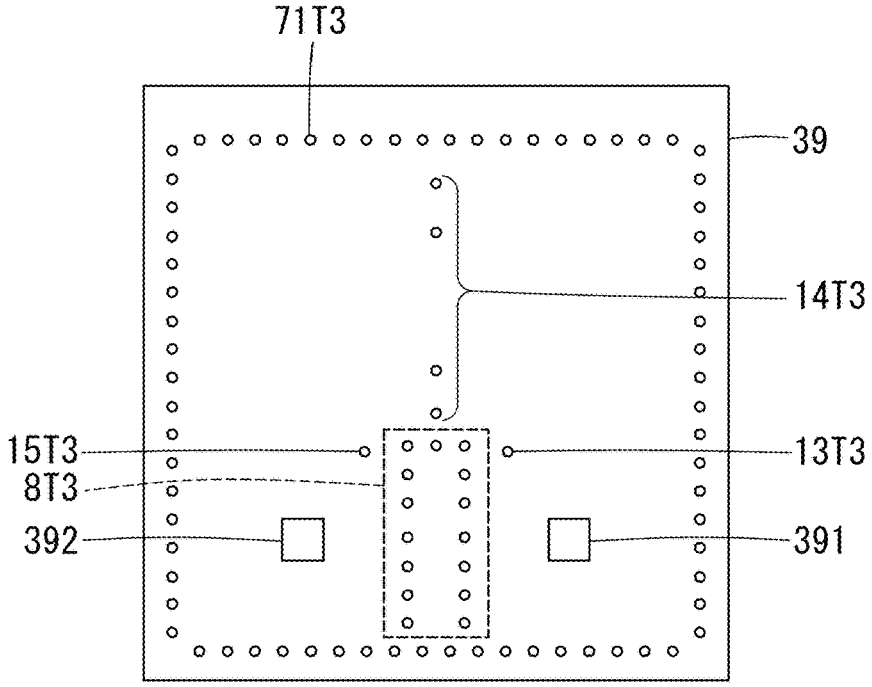
FIG. 10 is a plan view illustrating a patterned surface of a ninth dielectric layer of the peripheral dielectric portion shown in FIG. 1.

FIG. 10 illustrates a patterned surface of the ninth dielectric layer 39. Conductor layers 391 and 392 are formed on the patterned surface of the dielectric layer 39. The through holes 35T1 and 35T2 formed in the eighth dielectric layer 38 are connected to the conductor layers 391 and 392, respectively.

Further formed in the dielectric layer 39 are through holes 8T3, 13T3, 14T3, 15T3, and 71T3 constituting respective portions of the through hole lines 8T, 13T, 14T, 15T, and 71T. All the through holes in FIG. 10 except the through holes 8T3, 13T3, 14T3, and 15T3 are the through holes 71T3.

The through holes 8T2, 13T2, 14T2, 15T2, and 71T2 formed in the eighth dielectric layer 38 are respectively connected to the through holes 8T3, 13T3, 14T3, 15T3, and 71T3 formed in the dielectric layer 39.

Figure 11:
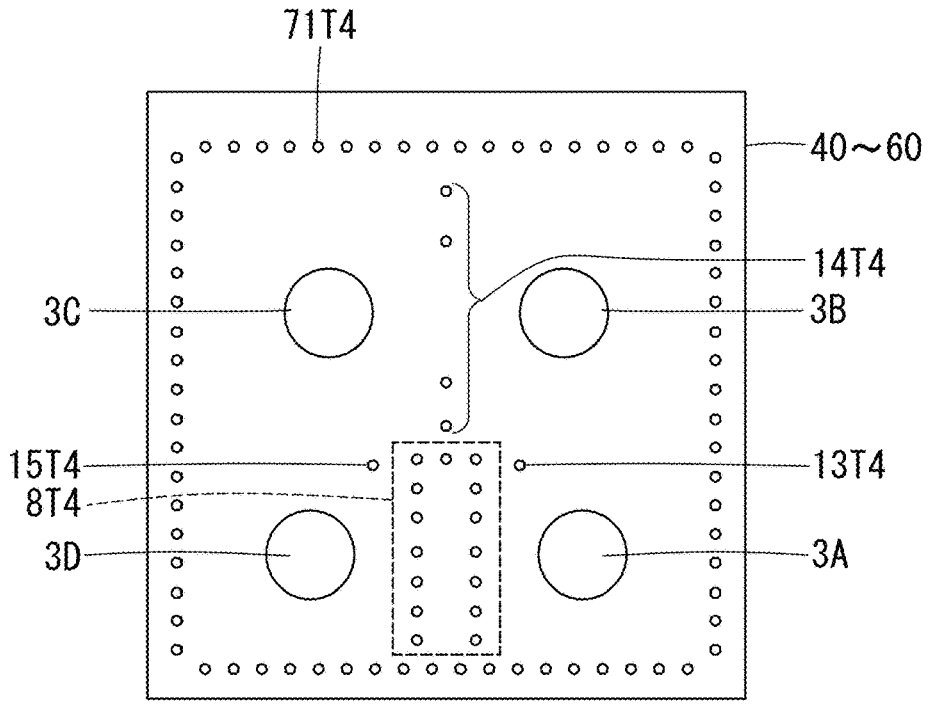
FIG. 11 is a plan view illustrating a patterned surface of each of a tenth to a thirtieth dielectric layer of the peripheral dielectric portion shown in FIG. 1.

FIG. 11 illustrates a patterned surface of each of the tenth to thirtieth dielectric layers 40 to 60. In each of the dielectric layers 40 to 60, there are formed through holes 8T4, 13T4, 14T4, 15T4, and 71T4 constituting respective portions of the through hole lines 8T, 13T, 14T, 15T, and 71T. All the through holes in FIG. 11 except the through holes 8T4, 13T4, 14T4, and 15T4 are the through holes 71T4.

The through holes 8T3, 13T3, 14T3, 15T3, and 71T3 shown in FIG. 10 are respectively connected to the through holes 8T4, 13T4, 14T4, 15T4, and 71T4 formed in the tenth dielectric layer 40. In the dielectric layers 40 to 60, every vertically adjacent through holes denoted by the same reference signs are connected to each other.

The resonator body portions 3A to 3D are provided to penetrate the dielectric layers 40 to 60. The conductor layer 391 shown in FIG. 10 is opposed to the bottom end face of the resonator body portion 3A with the dielectric layer 39 interposed therebetween. The conductor layer 392 shown in FIG. 10 is opposed to the bottom end face of the resonator body portion 3D with the dielectric layer 39 interposed therebetween.

Figure 12:
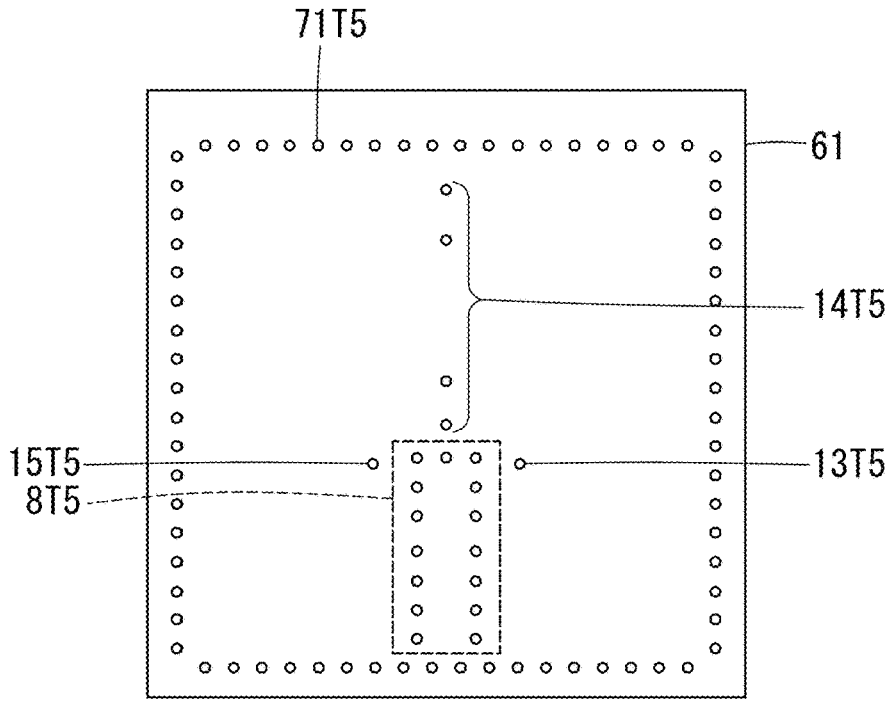
FIG. 12 is a plan view illustrating a patterned surface of a thirty-first dielectric layer of the peripheral dielectric portion shown in FIG. 1.

FIG. 12 illustrates a patterned surface of the thirty-first dielectric layer 61. In the dielectric layer 61, there are formed through holes 8T5, 13T5, 14T5, 15T5, and 71T5 constituting respective portions of the through hole lines 8T, 13T, 14T, 15T, and 71T. All the through holes in FIG. 12 except the through holes 8T5, 13T5, 14T5, and 15T5 are the through holes 71T5.

The through holes 8T4, 13T4, 14T4, 15T4, and 71T4 formed in the thirtieth dielectric layer 60 are respectively connected to the through holes 8T5, 13T5, 14T5, 15T5, and 71T5 formed in the dielectric layer 61.

Figure 13:
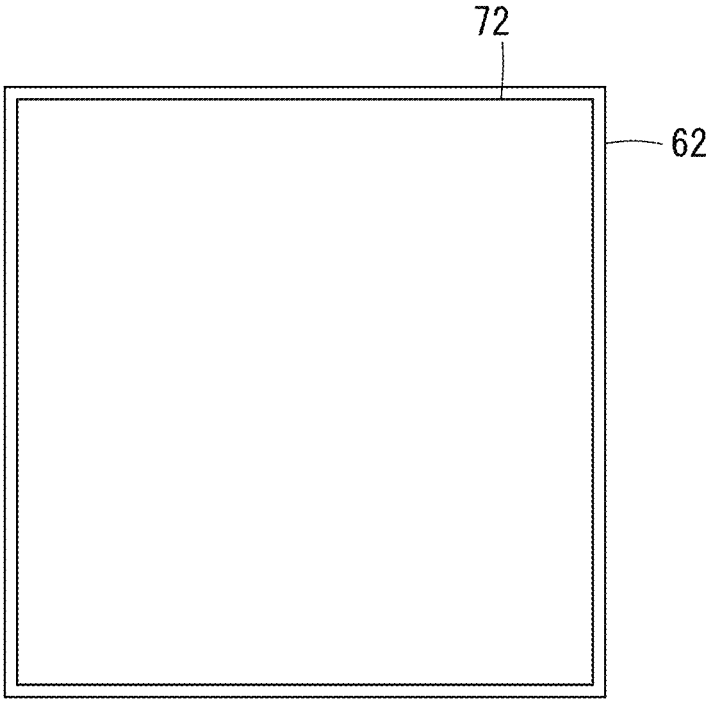
FIG. 13 is a plan view illustrating a patterned surface of a thirty-second dielectric layer of the peripheral dielectric portion shown in FIG. 1.

FIG. 13 illustrates a patterned surface of the thirty-second dielectric layer 62. The shield conductor layer 72 is formed on the patterned surface of the dielectric layer 62. The through holes 8T5, 13T5, 14T5, 15T5, and 71T5 shown in FIG. 12 are connected to the shield conductor layer 72.

The peripheral dielectric portion 4 is formed by stacking the dielectric layers 31 to 62 such that the patterned surface of the dielectric layer 31 shown in FIG. 5 constitutes the bottom surface 4*a* of the peripheral dielectric portion 4.

The capacitor C10 shown in FIG. 4 is composed of the conductor layer 331 shown in FIG. 7, the conductor layers 321 and 322 shown in FIG. 2, and the dielectric layer 32 interposed between the conductor layer 331 and the conductor layers 321, 322. The capacitor C10 lies in the area between the separation conductor layer 6 and the ground layer 9 within the structure 20. As previously mentioned, the resonator body portions 3A to 3D lie in the area between the separation conductor layer 6 and the shield conductor layer 72 within the structure 20. The separation conductor layer 6 thus separates the area where the resonator body portions 3A to 3D lie from the area where the capacitor C10 lies.

Some of the plurality of through hole lines 12T constituting the connection portion 12 are arranged to surround the conductor layers 321, 322, and 331 constituting the capacitor C10.

As shown in FIG. 2, the conductor layer 321 and the conductor layer 391 are connected to each other by a through hole line 11AT constituted of the through holes 32T1, 33T1, 34T1 and 35T1 connected in series. The conductor layer 322 and the conductor layer 392 are connected to each other by a through hole line 11BT constituted of the through holes 32T2, 33T2, 34T2 and 35T2 connected in series.

The first phase shifter 11A is composed of the conductor layer 321 and the through hole line 11AT. The second phase shifter 11B is composed of the conductor layer 322 and the through hole line 11BT.

The conductor layer 391 is opposed to the bottom end face of the resonator body portion 3A with the dielectric layer 39 interposed therebetween. The capacitive coupling C11A between the first phase shifter 11A and the first input/output stage resonator 2A is thereby provided. The conductor layer 392 is opposed to the bottom end face of the resonator body portion 3D with the dielectric layer 39 interposed therebetween. The capacitive coupling C11B between the second phase shifter 11B and the second input/output stage resonator 2D is thereby provided.

It should be noted that the dielectric layers 31, 32 and 33 need not necessarily be used as constituents of the peripheral dielectric portion 4, and the peripheral dielectric portion 4 may thus be constituted of the dielectric layers 34 to 62 stacked. In such a case, the dielectric forming the dielectric layers 31, 32 and 33 may have a relative permittivity higher than or equal to the first relative permittivity of the first dielectric forming the resonator body portions 3A to 3D.

Figure 14:
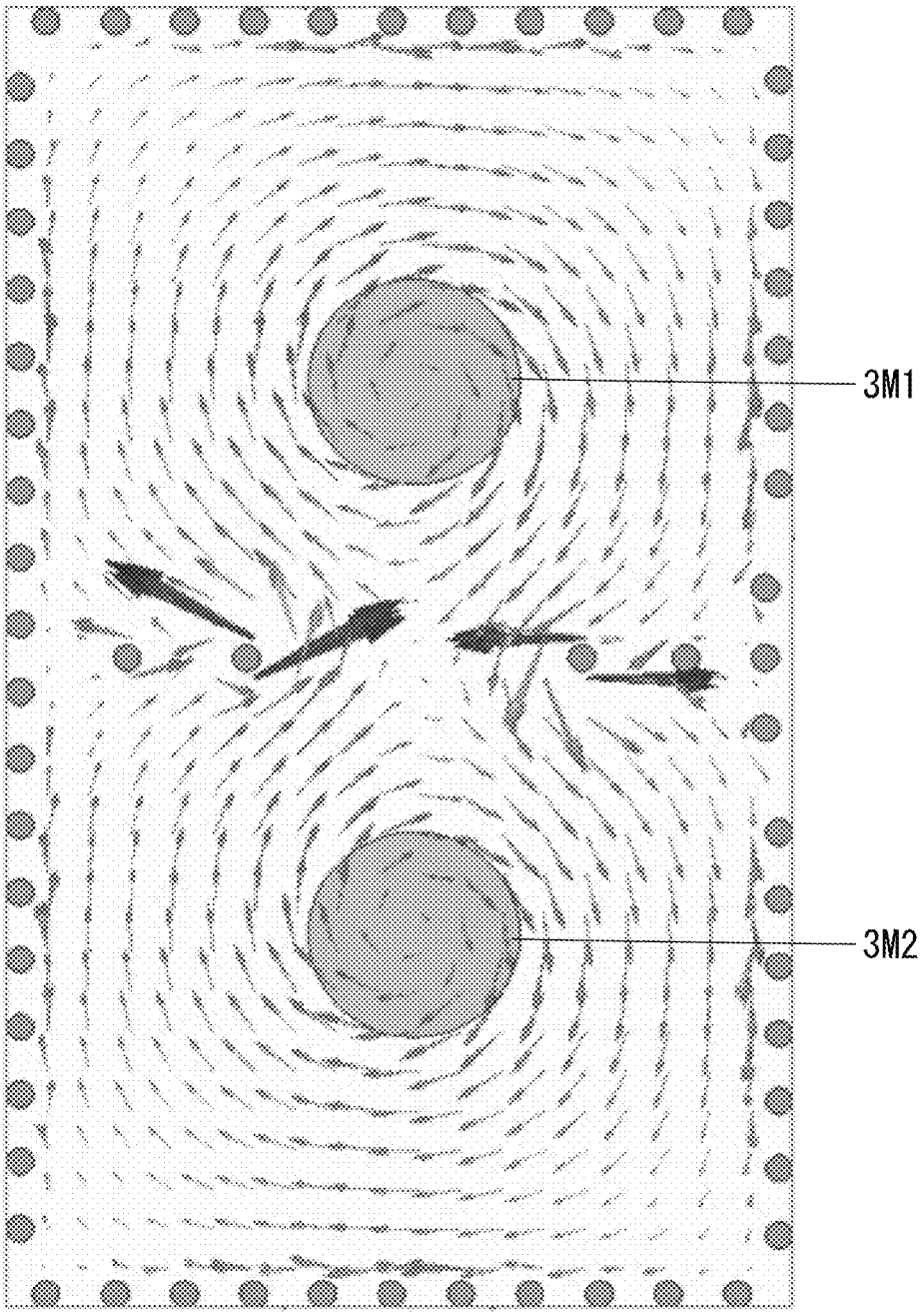
FIG. 14 is a plan view for explaining magnetic coupling between two dielectric resonators in the dielectric filter according to the first embodiment of the invention.
Figure 15:
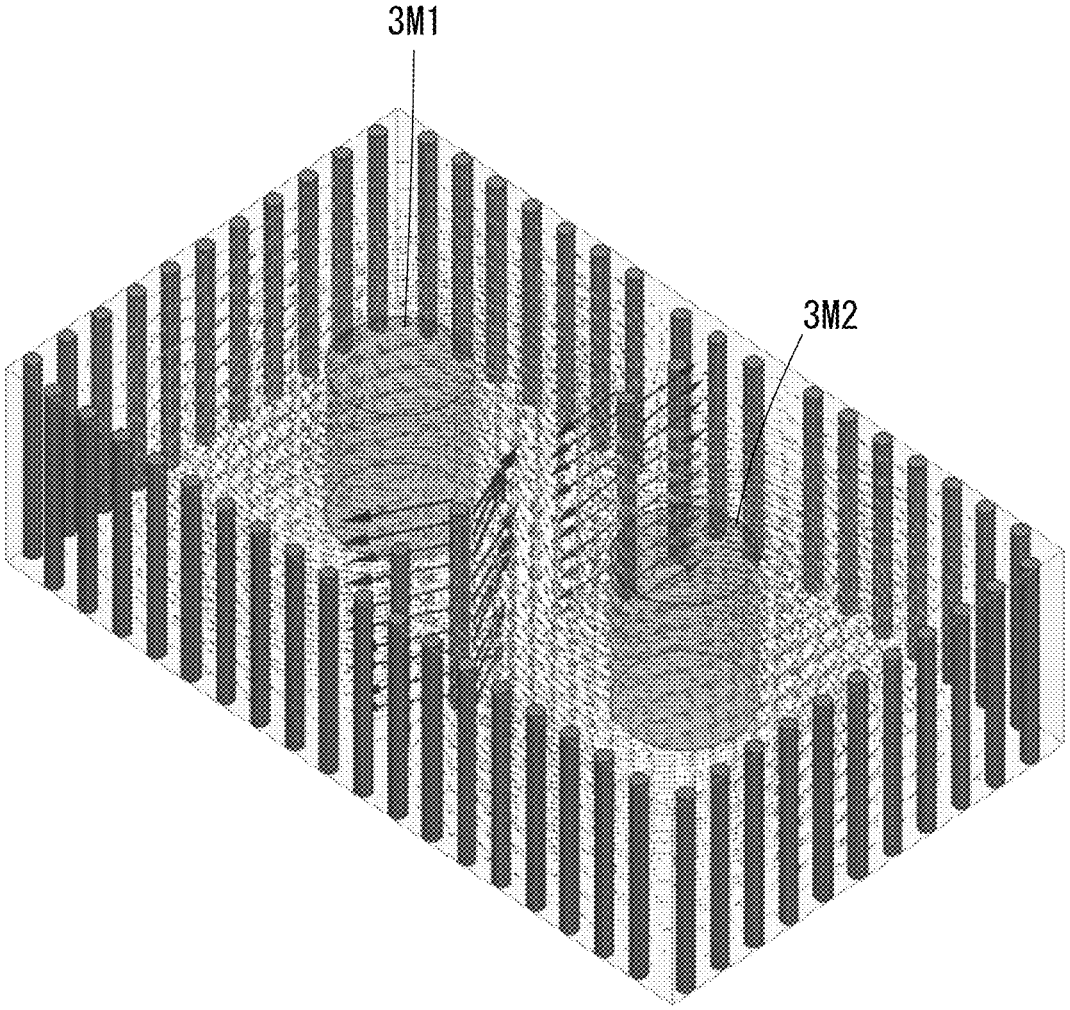
FIG. 15 is a perspective view for explaining magnetic coupling between two dielectric resonators in the dielectric filter according to the first embodiment of the invention.

Now, the magnetic coupling between two dielectric resonators adjacent to each other in circuit configuration will be described with reference to FIGS. 14 and 15 and in conjunction with the result of a simulation. FIG. 14 is a plan view of a model that was used in the simulation. FIG. 15 is a perspective view of the model. The model includes: two resonator body portions 3M1 and 3M2 corresponding to two dielectric resonators; a peripheral dielectric portion and a shield portion surrounding the two resonator body portions 3M1 and 3M2; and a coupling adjustment portion for adjusting the magnitude of the magnetic coupling between the two resonator body portions 3M1 and 3M2.

Arrows in FIGS. 14 and 15 represent the distribution of a magnetic field. The directions of the arrows indicate the directions of the magnetic field. The sizes of the arrows indicate the magnitude of the magnetic field. If the two dielectric resonators in the model shown in FIGS. 14 and 15 resonate in the TM mode, a magnetic field having a distribution shown in FIGS. 14 and 15 occurs around the resonator body portions 3M1 and 3M2. Part of the magnetic field passes through a plane between the resonator body portions 3M1 and 3M2. Magnetic coupling between the two dielectric resonators is thereby provided.

Next, a manufacturing method for the dielectric filter 1 according to the present embodiment will be described. This manufacturing method includes a step of fabricating an unfired multilayer stack which is to be fired later into the structure 20, and a step of subjecting the unfired multilayer stack to firing to complete the structure 20.

In the step of fabricating the unfired multilayer stack, a plurality of unfired ceramic sheets, which are to become the dielectric layers 31 to 62 later, are fabricated first. Next, a plurality of unfired through holes are formed in ones of the ceramic sheets that correspond to ones of the dielectric layers that each have a plurality of through holes formed therein. Further, one or more unfired conductor layers are formed on ones of the ceramic sheets that correspond to ones of the dielectric layers that each have one or more conductor layers formed thereon. Hereinafter, a ceramic sheet having either a plurality of unfired through holes formed therein or one or more unfired conductor layers formed thereon, or both, will be referred to as an unfired sheet.

In the step of fabricating the unfired multilayer stack, a plurality of unfired sheets corresponding to the dielectric layers 40 to 60 shown in FIG. 11 are then stacked together to form a part of the unfired multilayer stack. Next, four accommodation portions for accommodating the resonator body portions 3A to 3D are formed in the part of the unfired multilayer stack. The resonator body portions 3A to 3D are then accommodated into the four accommodation portions. Next, the part of the unfired multilayer stack and a plurality of unfired sheets constituting the remaining part of the unfired multilayer stack are stacked together to complete the unfired multilayer stack.

Next, the operation and effect of the dielectric filter 1 according to the present embodiment will be described. The dielectric filter 1 has a band-pass filter function. The dielectric filter 1 is designed and configured to have a passband in, for example, a quasi-millimeter wave band of 10 to 30 GHz or a millimeter wave band of 30 to 300 GHz. Note that the passband refers to, for example, a frequency band between two frequencies at which the insertion loss is higher by 3 dB than the minimum value of the insertion loss.

The dielectric filter 1 includes the even number of dielectric resonators 2A to 2D configured so that two dielectric resonators adjacent to each other in circuit configuration are magnetically coupled to each other, and the capacitor C10 for capacitively coupling the first input/output port 5A and the second input/output port 5B. The dielectric filter 1 of such a configuration is able to provide a first attenuation pole and a second attenuation pole in the frequency response of the insertion loss. The first attenuation pole occurs in a first passband-neighboring region, which is a frequency region close to the passband and lower than the passband. The second attenuation pole occurs in a second passband-neighboring region, which is a frequency region close to the passband and higher than the passband.

The two frequencies at which the first and second attenuation poles occur in the frequency response of the insertion loss of the dielectric filter 1 are two frequencies at which the absolute value of a difference between an even mode impedance Ze of the dielectric filter 1 and an odd mode impedance Zo of the dielectric filter 1, i.e., |Ze−Zo|, takes on a minimum value. For the dielectric filter 1 according to the present embodiment, one of the two frequencies at which the absolute value |Ze−Zo| takes on a minimum value is present in the first passband-neighboring region, and the other is present in the second passband-neighboring region. Accordingly, the dielectric filter 1 is able to cause the first attenuation pole and the second attenuation pole to occur in the first passband-neighboring region and the second passband-neighboring region, respectively. By virtue of this, the present embodiment achieves such a characteristic of the dielectric filter 1 that the insertion loss changes steeply in the first and second passband-neighboring regions.

If the number of the dielectric resonators provided between the first input/output port 5A and the second input/output port 5B is an odd number, an attenuation pole occurs only in the first passband-neighboring region even if the first input/output port 5A and the second input/output port 5B are capacitively coupled to each other.

On the other hand, an attenuation pole occurs only in the second passband-neighboring region if the number of the dielectric resonators provided between the first input/output port 5A and the second input/output port 5B is an even number greater than or equal to four and magnetic coupling is established between one of the dielectric resonators that is closest to the first input/output port 5A in circuit configuration and another one of the dielectric resonators that is closest to the second input/output port 5B in circuit configuration.

The frequency response of the insertion loss of the dielectric filter 1 is adjustable by adjusting the phase change amounts to be obtained at the first and second phase shifters 11A and 11B. The phase change amounts at the first and second phase shifters 11A and 11B are changeable by changing the lengths of the first and second phase shifters 11A and 11B.

Now, an example of the characteristic of the dielectric filter 1 determined by simulation will be described with reference to FIGS. 16 to 18.

Figure 16:
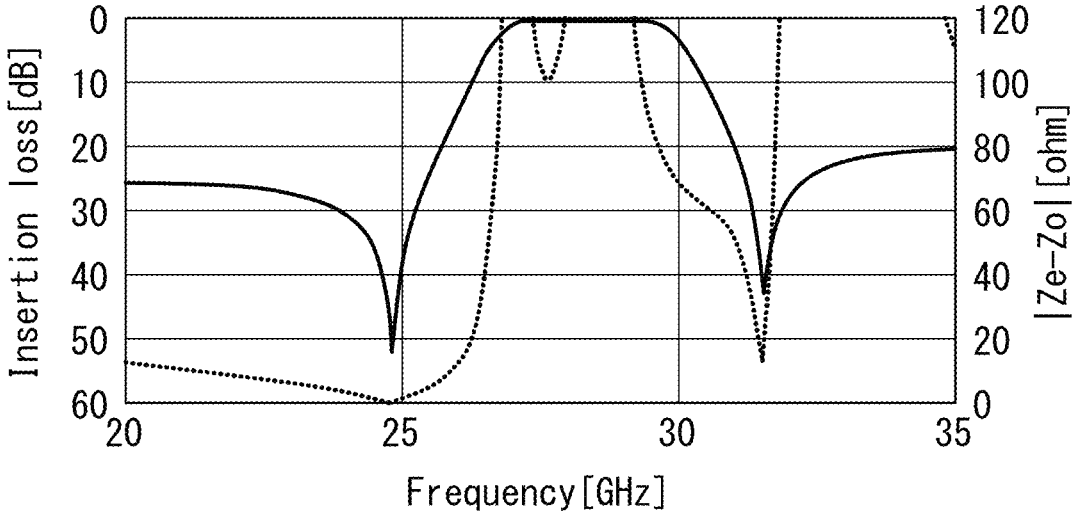
FIG. 16 is a characteristic diagram illustrating a first example characteristic of the dielectric filter according to the first embodiment of the invention.

FIG. 16 shows an example of the characteristic of the dielectric filter 1 that is configured so that the first input/output port 5A is capacitively coupled to the dielectric resonator 2A and the second input/output port 5B is capacitively coupled to the dielectric resonator 2D without the provision of the first and second phase shifters 11A and 11B.

Figure 17:
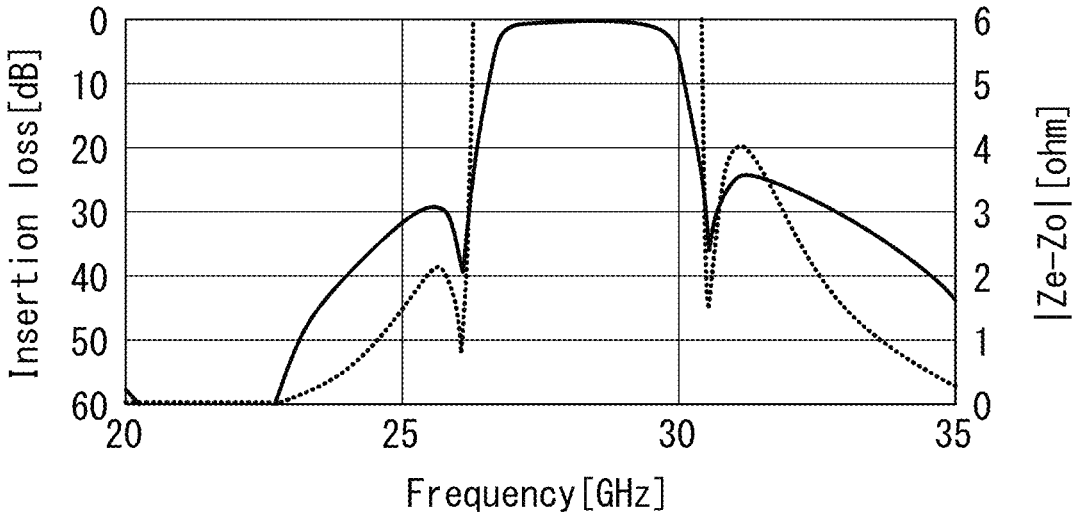
FIG. 17 is a characteristic diagram illustrating a second example characteristic of the dielectric filter according to the first embodiment of the invention.

FIG. 17 shows an example of the characteristic of the dielectric filter 1 with the respective phase change amounts at the first and second phase shifters 11A and 11B adjusted to be 74.4° at a frequency of 29 GHz. In FIGS. 16 and 17, the solid line represents the frequency response of the insertion loss, and the dotted line the frequency response of the foregoing absolute value |Ze−Zo|. In FIGS. 16 and 17, the horizontal axis represents frequency, the left vertical axis represents insertion loss, and the right vertical axis represents the absolute value |Ze−Zo|.

As can be seen from FIGS. 16 and 17, by providing the first and second phase shifters 11A and 11B and adjusting the respective phase change amounts at the first and second phase shifters 11A and 11B to appropriate magnitude, it becomes possible to bring the frequency at which the first attenuation pole occurs and the frequency at which the second attenuation pole occurs closer to the passband and to thereby achieve such a characteristic of the dielectric filter 1 that the insertion loss changes in the first and second passband-neighboring regions more steeply, compared with the case where the the first and second phase shifters 11A and 11B are not provided.

Figure 18:
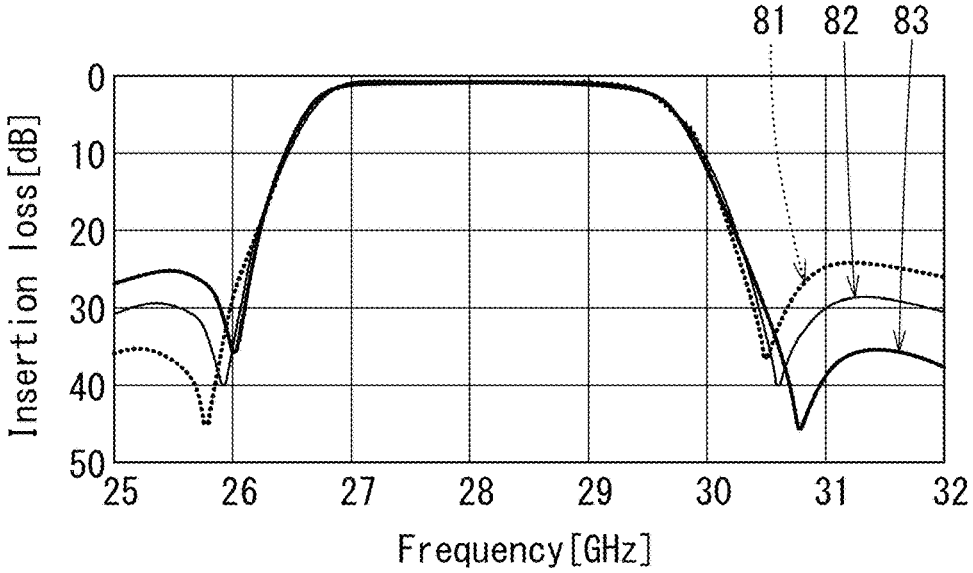
FIG. 18 is a characteristic diagram for explaining the operation of first and second phase shifters of the dielectric filter according to the first embodiment of the invention.

FIG. 18 shows variations in the frequency response of the insertion loss of the dielectric filter 1 with varying phase change amounts at the first and second phase shifters 11A and 11B. In FIG. 18, the curve 81 represents the frequency response when the phase change amounts are adjusted to be 70° at a frequency of 29 GHz. The curve 82 represents the frequency response when the phase change amounts are adjusted to be 75° at a frequency of 29 GHz. The curve 83 represents the frequency response when the phase change amounts are adjusted to be 80° at a frequency of 29 GHz. In FIG. 18, the horizontal axis represents frequency, and the vertical axis represents insertion loss.

As can be seen from FIG. 18, the frequency response of the insertion loss of the dielectric filter 1 is adjustable by adjusting the phase change amounts.

The two attenuation poles in the frequency response of the insertion loss of the dielectric filter 1 are generated by capacitively coupling the first input/output port 5A and the second input/output port 5B, instead of electromagnetically coupling two dielectric resonators that are not adjacent to each other in circuit configuration. The capacitive coupling between the first input/output port 5A and the second input/output port 5B is provided by the capacitor C10 of a simple structure.

By virtue of the foregoing, the dielectric filter 1 according to the present embodiment is able to provide two attenuation poles in the frequency response of the insertion loss while being simple in structure.

In the present embodiment, the structure 20 includes the separation conductor layer 6 which separates the area where the resonator body portions 3A to 3D lie from the area where the capacitor C10 lies. This enables the capacitive coupling between the first input/output port 5A and the second input/output port 5B to occur without affecting any electromagnetic field around the resonator body portions 3A to 3D.

In the present embodiment, the first input/output stage resonator body portion 3A and the second input/output stage resonator body portion 3D are physically adjacent to each other with neither of the intermediate resonator body portions 3B and 3C interposed therebetween. This enables the first and second input/output ports 5A and 5B to be brought close to each other, thus making it easy to construct the capacitor C10.

Second Embodiment

Figure 19:
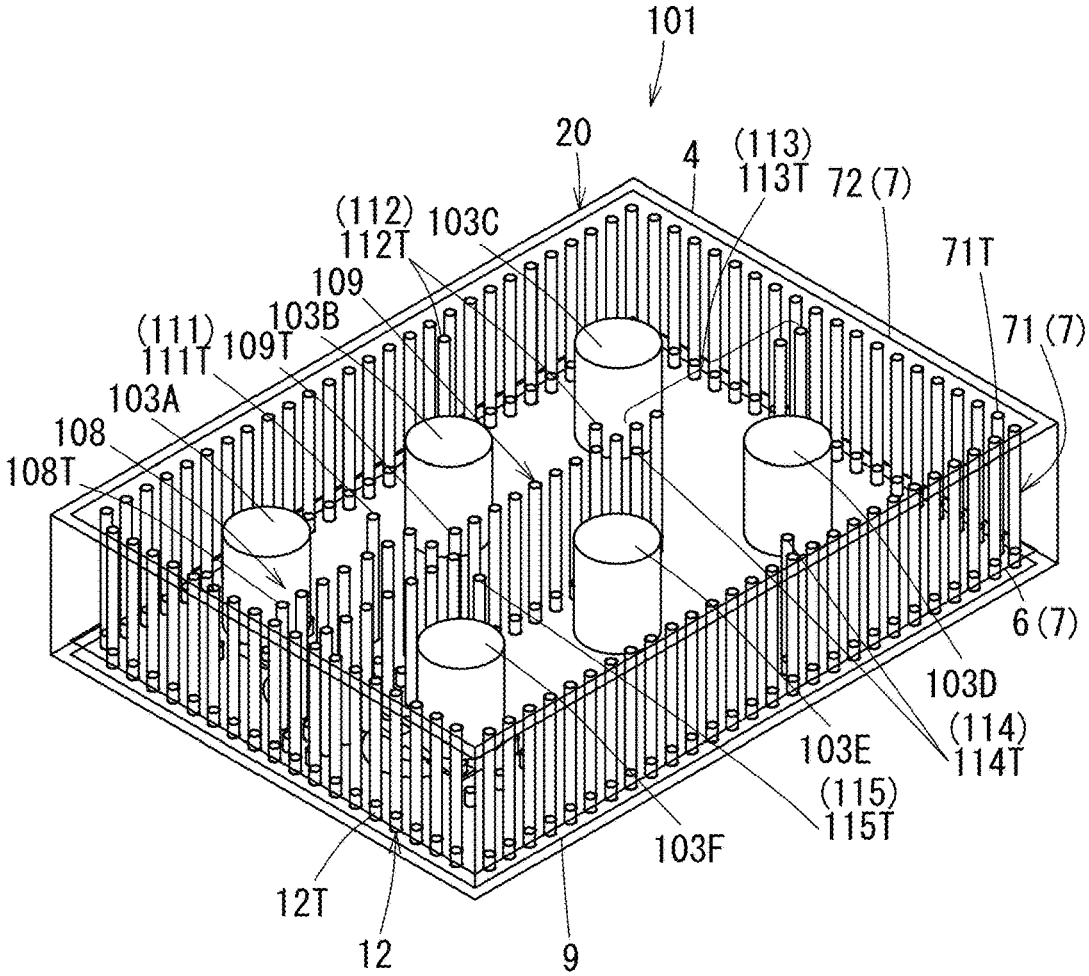
FIG. 19 is a perspective view illustrating the interior of a dielectric filter according to a second embodiment of the invention.
Figure 20:
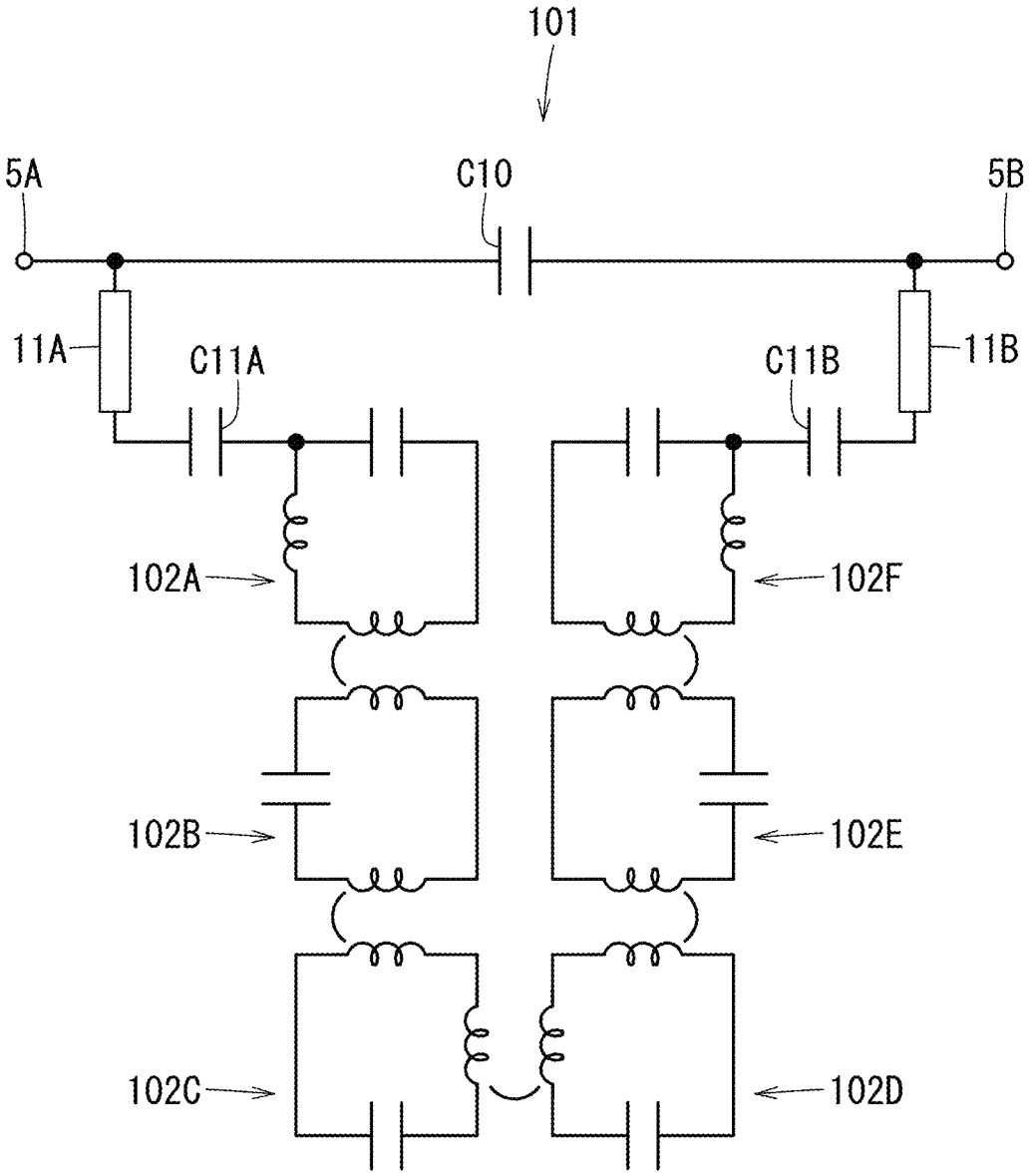
FIG. 20 is a circuit diagram illustrating an equivalent circuit of the dielectric filter according to the second embodiment of the invention.

A second embodiment of the invention will now be described. FIG. 19 is a perspective view illustrating the interior of a dielectric filter according to the second embodiment. FIG. 20 is a circuit diagram illustrating an equivalent circuit of the dielectric filter according to the second embodiment.

As shown in FIG. 20, the dielectric filter 101 according to the present embodiment includes six dielectric resonators 102A, 102B, 102C, 102D, 102E, and 102F provided between the first input/output port 5A and the second input/output port 5B in circuit configuration, in place of the four dielectric resonators 2A, 2B, 2C, and 2D of the dielectric filter 1 according to the first embodiment.

The dielectric resonators 102A, 102B, 102C, 102D, 102E, and 102F are arranged in this order, from closest to farthest, from the first input/output port 5A in circuit configuration. The dielectric resonators 102A to 102F are configured so that: the dielectric resonators 102A and 102B are adjacent to each other in circuit configuration and are magnetically coupled to each other; the dielectric resonators 102B and 102C are adjacent to each other in circuit configuration and are magnetically coupled to each other; the dielectric resonators 102C and 102D are adjacent to each other in circuit configuration and are magnetically coupled to each other; the dielectric resonators 102D and 102E are adjacent to each other in circuit configuration and are magnetically coupled to each other; and the dielectric resonators 102E and 102F are adjacent to each other in circuit configuration and are magnetically coupled to each other. Each of the dielectric resonators 102A to 102F has an inductance and a capacitance.

Hereinafter, the dielectric resonator 102A which is closest to the first input/output port 5A in circuit configuration will also be referred to as the first input/output stage resonator 102A, and the dielectric resonator 102F which is closest to the second input/output port 5B in circuit configuration will also be referred to as the second input/output stage resonator 102F. The other four dielectric resonators 102B, 102C, 102D and 102E lying between the first and second input/output stage resonators 102A and 102F in circuit configuration will also be referred to as the intermediate resonators 102B, 102C, 102D and 102E.

In the present embodiment, the first phase shifter 11A is provided between the first input/output port 5A and the first input/output stage resonator 102A in circuit configuration. The first phase shifter 11A is configured to be capacitively coupled to the first input/output stage resonator 102A. In FIG. 20, the capacitor symbol C11A represents the capacitive coupling between the first phase shifter 11A and the first input/output stage resonator 102A.

The second phase shifter 11B is provided between the second input/output port 5B and the second input/output stage resonator 102F in circuit configuration. The second phase shifter 11B is configured to be capacitively coupled to the second input/output stage resonator 102F. In FIG. 20, the capacitor symbol C11B represents the capacitive coupling between the second phase shifter 11B and the second input/output stage resonator 102F.

As shown in FIG. 19, the dielectric filter 101 includes a structure 20 for constructing the first and second input/output ports 5A and 5B, the dielectric resonators 102A to 102F, the capacitor C10 and the first and second phase shifters 11A and 11B.

The structure 20 includes six resonator body portions 103A, 103B, 103C, 103D, 103E and 103F corresponding to the six dielectric resonators 102A, 102B, 102C, 102D, 102E and 102F, respectively, and a peripheral dielectric portion 4 lying around the six resonator body portions 103A to 103F. Each of the six resonator body portions 103A to 103F is formed of a first dielectric having a first relative permittivity. The peripheral dielectric portion 4 is formed of a second dielectric having a second relative permittivity lower than the first relative permittivity.

Hereinafter, the resonator body portion 103A corresponding to the first input/output stage resonator 102A will also be referred to as the first input/output stage resonator body portion 103A, and the resonator body portion 103F corresponding to the second input/output stage resonator 102F will also be referred to as the second input/output stage resonator body portion 103F. The resonator body portions 103B, 103C, 103D and 103E corresponding to the intermediate resonators 102B, 102C, 102D and 102E will also be referred to as the intermediate resonator body portions 103B, 103C, 103D and 103E.

The shape and configuration of each of the resonator body portions 103A to 103F are the same as those of one of the resonator body portions 3A to 3D of the first embodiment.

The resonator body portions 103A to 103F are configured so that the resonator body portions 103A and 103B are magnetically coupled to each other, the resonator body portions 103B and 103C are magnetically coupled to each other, the resonator body portions 103C and 103D are magnetically coupled to each other, the resonator body portions 103D and 103E are magnetically coupled to each other, and the resonator body portions 103E and 103F are magnetically coupled to each other.

In the present embodiment, the structure 20 includes a separation conductor layer 6 and a shield portion 7 each formed of a conductor, as in the first embodiment. The separation conductor layer 6 also serves as part of the shield portion 7. The shield portion 7 includes the separation conductor layer 6, a shield conductor layer 72, and a connection portion 71.

The separation conductor layer 6 separates the area where the resonator body portions 103A to 103F lie from the area where the capacitor C10 lies.

The shield portion 7 lies around the resonator body portions 103A to 103F such that at least part of the peripheral dielectric portion 4 is interposed between the shield portion 7 and the resonator body portions 103A to 103F.

The resonator body portions 103A to 103F lie in the area between the separation conductor layer 6 and the shield conductor layer 72 within the structure 20. Each of the resonator body portions 103A to 103F has a top end face closest to the shield conductor layer 72 and a bottom end face closest to the separation conductor layer 6.

The connection portion 71 electrically connects the separation conductor layer 6 and the shield conductor layer 72. The connection portion 71 includes a plurality of through hole lines 71T. The separation conductor layer 6, the shield conductor layer 72 and the connection portion 71 are arranged to surround the resonator body portions 103A to 103F. Each of the resonator body portions 103A to 103F is in non-contact with the shield portion 7.

As shown in FIG. 19, the first input/output stage resonator body portion 103A and the second input/output stage resonator body portion 103F are physically adjacent to each other with none of the intermediate resonator body portions 103B to 103E interposed therebetween.

As shown in FIG. 19, the structure 20 further includes partitions 108 and 109, a ground layer 9, and a connection portion 12, each formed of a conductor.

The partition 108 is intended to prevent the occurrence of magnetic coupling between the first input/output stage resonator body portion 103A and the second input/output stage resonator body portion 103F. The partition 108 is arranged to pass between the first input/output stage resonator body portion 103A and the second input/output stage resonator body portion 103F. The partition 108 electrically connects the separation conductor layer 6 and the shield conductor layer 72. The partition 108 includes a plurality of through hole lines 108T. Each of the plurality of through hole lines 108T includes two or more through holes connected in series.

The partition 109 is intended to prevent the occurrence of magnetic coupling between the resonator body portion 103B and the resonator body portion 103E. The partition 109 is arranged to pass between the resonator body portion 103B and the resonator body portion 103E. The partition 109 electrically connects the separation conductor layer 6 and the shield conductor layer 72. The partition 109 includes a plurality of through hole lines 109T. Each of the plurality of through hole lines 109T includes two or more through holes connected in series.

The connection portion 12 electrically connects the ground layer 9 and the separation conductor layer 6. The connection portion 12 includes a plurality of through hole lines 12T.

As shown in FIG. 19, the structure 20 further includes coupling adjustment portions 111, 112, 113, 114 and 115 each formed of a conductor.

The coupling adjustment portion 111 is intended to adjust the magnitude of the magnetic coupling between the resonator body portions 103A and 103B. The coupling adjustment portion 112 is intended to adjust the magnitude of the magnetic coupling between the resonator body portions 103B and 103C. The coupling adjustment portion 113 is intended to adjust the magnitude of the magnetic coupling between the resonator body portions 103C and 103D. The coupling adjustment portion 114 is intended to adjust the magnitude of the magnetic coupling between the resonator body portions 103D and 103E. The coupling adjustment portion 115 is intended to adjust the magnitude of the magnetic coupling between the resonator body portions 103E and 103F. Each of the coupling adjustment portions 111 to 115 electrically connects the separation conductor layer 6 and the shield conductor layer 72.

In the example shown in FIG. 19, the coupling adjustment portion 111 includes a single through hole line 111T. The coupling adjustment portion 112 includes two through hole lines 112T. The coupling adjustment portion 113 includes four through hole lines 113T. The coupling adjustment portion 114 includes two through hole lines 114T. The coupling adjustment portion 115 includes a single through hole line 115T. Each of the through hole lines 111T, 112T, 113T, 114T and 115T includes two or more through holes connected in series.

The dielectric resonator 102A is composed of the resonator body portion 103A, at least part of the peripheral dielectric portion 4, and the shield portion 7. The dielectric resonator 102B is composed of the resonator body portion 103B, at least part of the peripheral dielectric portion 4, and the shield portion 7. The dielectric resonator 102C is composed of the resonator body portion 103C, at least part of the peripheral dielectric portion 4, and the shield portion 7. The dielectric resonator 102D is composed of the resonator body portion 103D, at least part of the peripheral dielectric portion 4, and the shield portion 7. The dielectric resonator 102E is composed of the resonator body portion 103E, at least part of the peripheral dielectric portion 4, and the shield portion 7. The dielectric resonator 102F is composed of the resonator body portion 103F, at least part of the peripheral dielectric portion 4, and the shield portion 7.

The resonance mode of each of the dielectric resonators 102A to 102F is a TM mode. An electromagnetic field generated by the dielectric resonators 102A to 102F is present inside and outside the resonator body portions 103A to 103F. The shield portion 7 has a function of confining the electromagnetic field outside the resonator body portions 103A to 103F to within the area surrounded by the shield portion 7.

Reference is now made to FIGS. 21 to 29 to describe an example of the plurality of dielectric layers constituting the peripheral dielectric portion 4 of the present embodiment and an example of the configurations of a plurality of conductor layers formed on the dielectric layers and a plurality of through holes formed in the dielectric layers. In this example, the peripheral dielectric portion 4 has thirty-two dielectric layers stacked together. The thirty-two dielectric layers will hereinafter be referred to as the first to thirty-second dielectric layers, respectively, in the order from bottom to top. The first to thirty-second dielectric layers will be denoted by the reference numerals 131 to 162, respectively. In FIGS. 21 to 28, each small circle represents a through hole.

Figure 21:
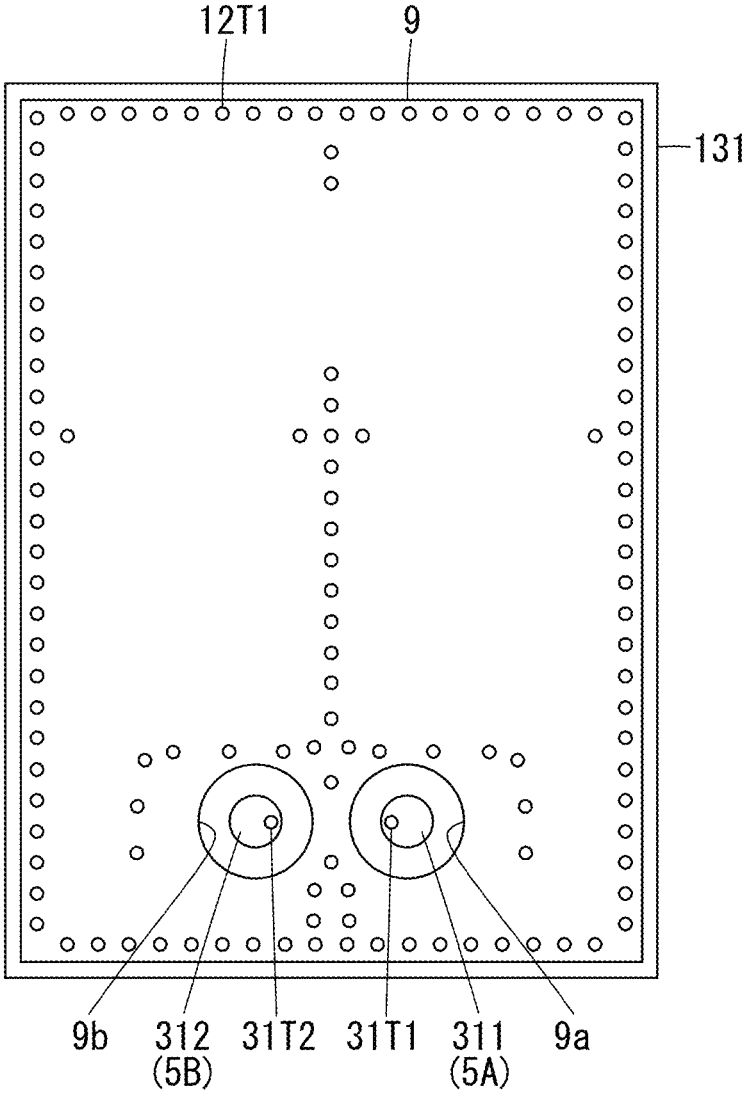
FIG. 21 is a plan view illustrating a patterned surface of a first dielectric layer of a peripheral dielectric portion shown in FIG. 19.

FIG. 21 illustrates a patterned surface of the first dielectric layer 131. On the patterned surface of the dielectric layer 131, there are formed the ground layer 9, a conductor layer 311 forming the first input/output port 5A, and a conductor layer 312 forming the second input/output port 5B. Two circular holes 9*a* and 9*b* are formed in the ground layer 9. The conductor layer 311 lies inside the hole 9*a*, and the conductor layer 312 lies inside the hole 9*b*.

Further, a through hole 31T1 connected to the conductor layer 311, and a through hole 31T2 connected to the conductor layer 312 are formed in the dielectric layer 131. Further formed in the dielectric layer 131 are a plurality of through holes 12T1 constituting respective portions of the plurality of through hole lines 12T. All the through holes in FIG. 21 except the through holes 31T1 and 31T2 are the through holes 12T1. The through holes 12T1 are connected to the ground layer 9.

Figure 22:
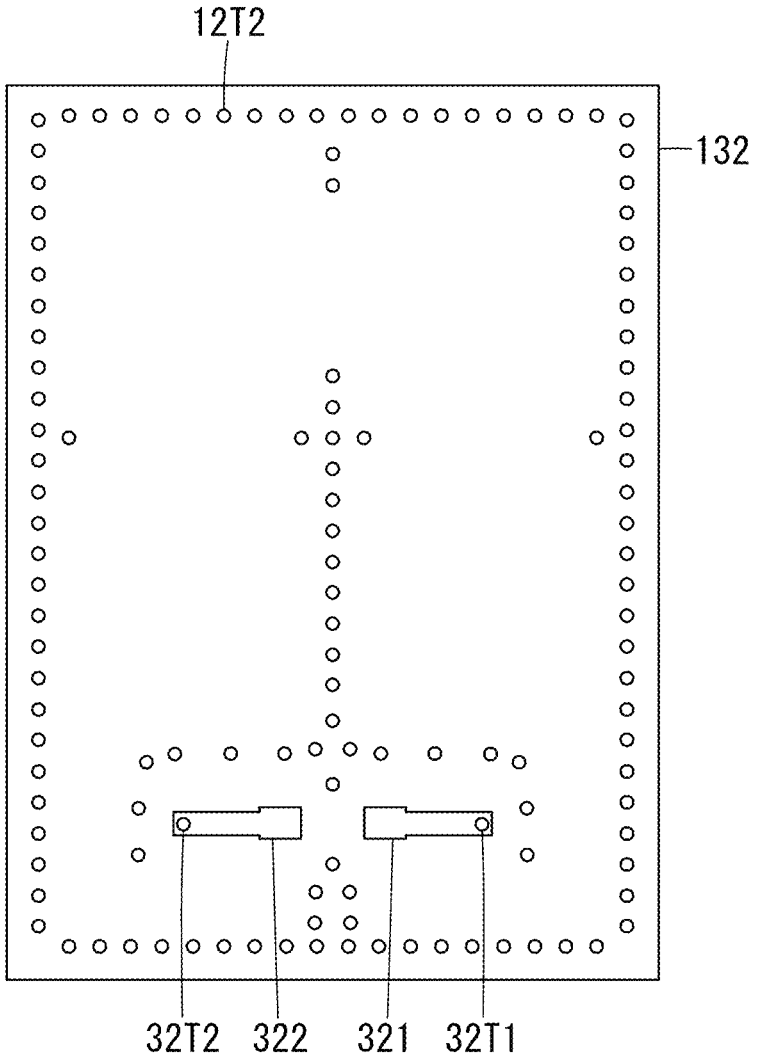
FIG. 22 is a plan view illustrating a patterned surface of a second dielectric layer of the peripheral dielectric portion shown in FIG. 19.

FIG. 22 illustrates a patterned surface of the second dielectric layer 132. Conductor layers 321 and 322 are formed on the patterned surface of the dielectric layer 132. The shape and location of each of the conductor layers 321 and 322 are the same as those in the first embodiment. The through hole 31T1 shown in FIG. 21 is connected to a portion of the conductor layer 321 near the first end thereof. The through hole 31T2 shown in FIG. 21 is connected to a portion of the conductor layer 322 near the first end thereof.

Further formed in the dielectric layer 132 are a through hole 32T1 connected to a portion of the conductor layer 321 near the second end thereof, and a through hole 32T2 connected to a portion of the conductor layer 322 near the second end thereof. Further formed in the dielectric layer 132 are a plurality of through holes 12T2 constituting respective portions of the plurality of through hole lines 12T. All the through holes in FIG. 22 except the through holes 32T1 and 32T2 are the through holes 12T2. The through holes 12T1 shown in FIG. 21 are respectively connected to the through holes 12T2.

Figure 23:
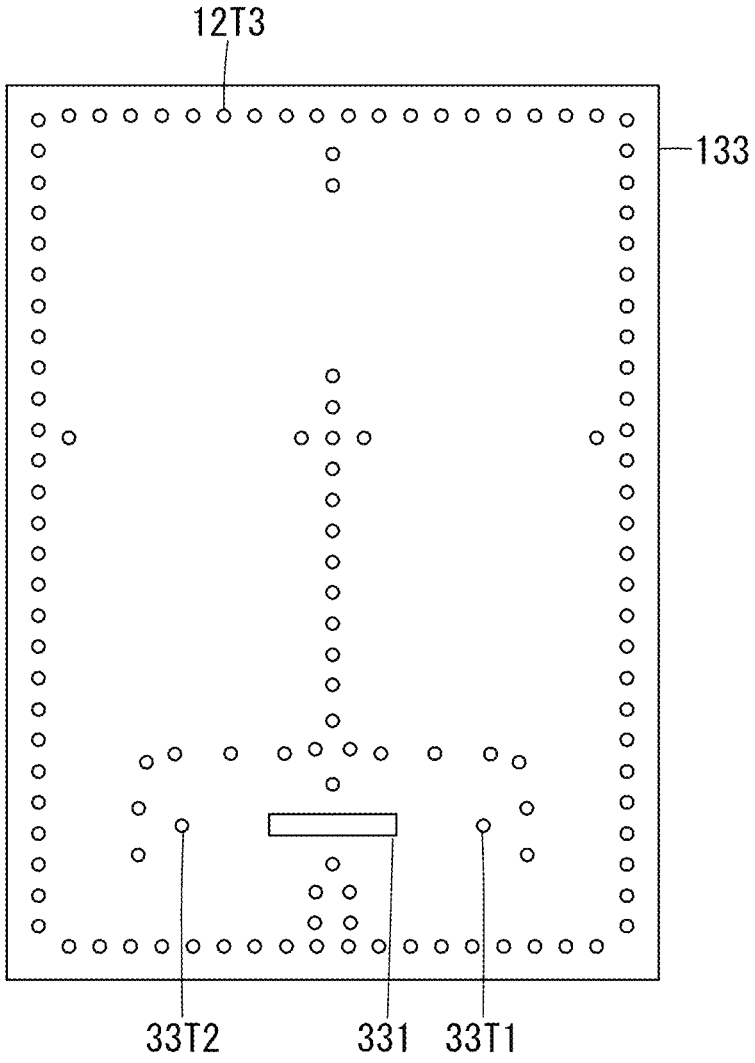
FIG. 23 is a plan view illustrating a patterned surface of a third dielectric layer of the peripheral dielectric portion shown in FIG. 19.

FIG. 23 illustrates a patterned surface of the third dielectric layer 133. A conductor layer 331 long in the X direction is formed on the patterned surface of the dielectric layer 133. A portion of the conductor layer 331 is opposed to the portion of the conductor layer 321 near the first end thereof with the dielectric layer 132 interposed therebetween. Another portion of the conductor layer 331 is opposed to the portion of the conductor layer 322 near the first end thereof with the dielectric layer 132 interposed therebetween.

Further formed in the dielectric layer 133 are through holes 33T1 and 33T2, and through holes 12T3 constituting respective portions of the through hole lines 12T. The through holes 32T1 and 32T2 shown in FIG. 22 are connected to the through holes 33T1 and 33T2, respectively. All the through holes in FIG. 23 except the through holes 33T1 and 33T2 are the through holes 12T3. The through holes 12T2 shown in FIG. 22 are respectively connected to the through holes 12T3.

Figure 24:
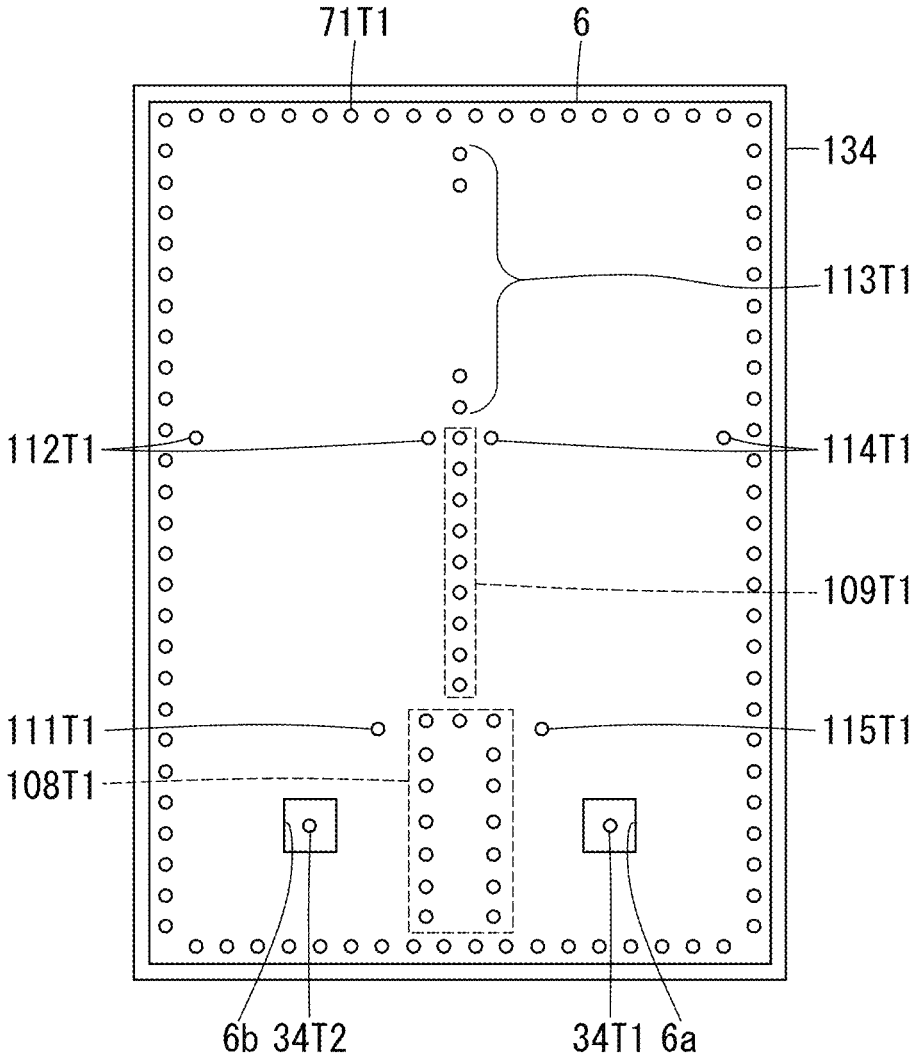
FIG. 24 is a plan view illustrating a patterned surface of a fourth dielectric layer of the peripheral dielectric portion shown in FIG. 19.

FIG. 24 illustrates a patterned surface of the fourth dielectric layer 134. The separation conductor layer 6 is formed on the patterned surface of the dielectric layer 134. Two rectangular holes 6*a* and 6*b* are formed in the separation conductor layer 6.

Through holes 34T1 and 34T2 are formed in the dielectric layer 134. Further formed in the dielectric layer 134 are through holes 71T1, 108T1, 109T1, 111T1, 1112T1, 113T1, 114T1, and 115T1 constituting respective portions of the through hole lines 71T, 108T, 109T, 111T, 112T, 113T, 114T, and 115T. All the through holes in FIG. 24 except the through holes 34T1, 34T2, 108T1, 109T1, 111T1, 112T1, 113T1, 114T1 and 115T1 are the through holes 71T1.

The through hole 34T1 lies inside the hole 6*a*, and the through hole 34T2 lies inside the hole 6*b*. The through holes 33T1 and 33T2 shown in FIG. 23 are connected to the through holes 34T1 and 34T2, respectively.

In FIG. 24, all the through holes except the through holes 34T1 and 34T2 are connected to the separation conductor layer 6. The separation conductor layer 6 has a rectangular perimeter. The through holes 71T1 are connected to the separation conductor layer 6 at its areas near the perimeter.

Figure 25:
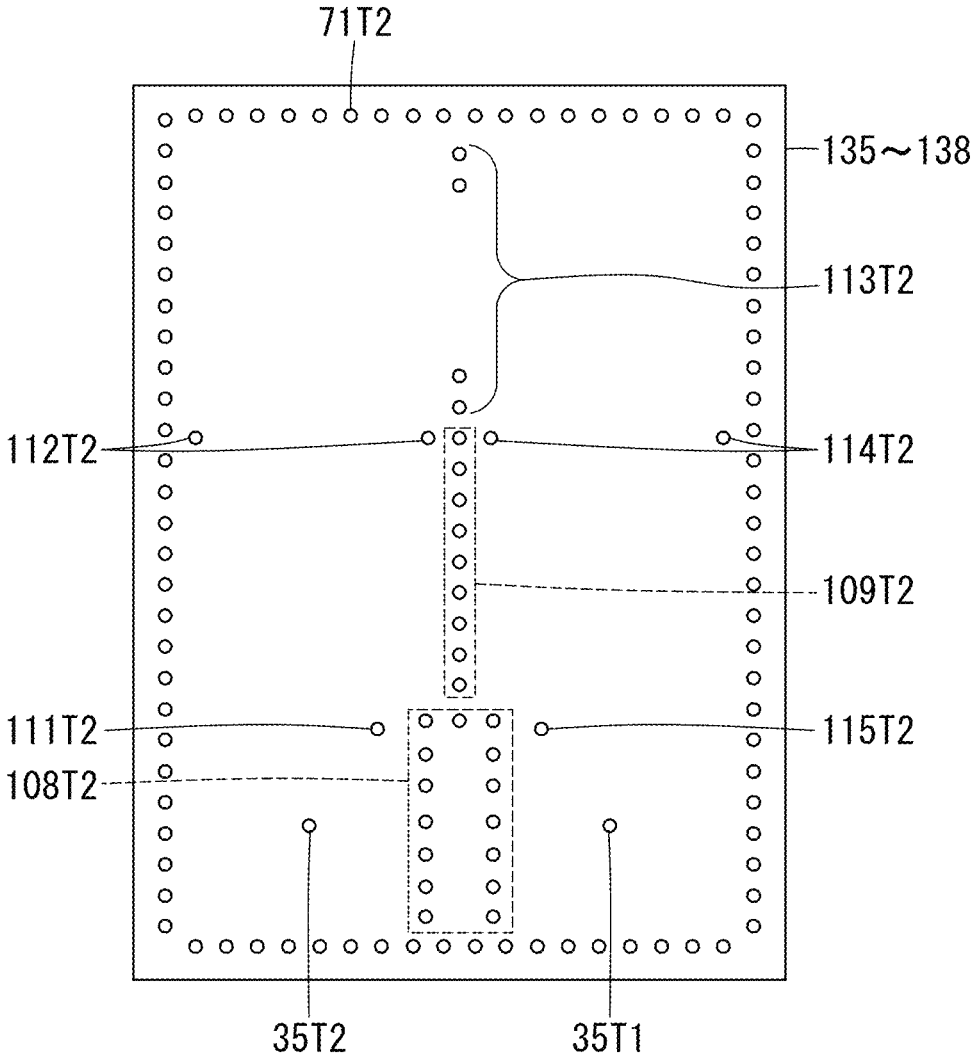
FIG. 25 is a plan view illustrating a patterned surface of each of a fifth to an eighth dielectric layer of the peripheral dielectric portion shown in FIG. 19.

FIG. 25 illustrates a patterned surface of each of the fifth to eighth dielectric layers 135 to 138. Through holes 35T1 and 35T2 are formed in each of the dielectric layers 135 to 138. Further formed in each of the dielectric layers 135 to 138 are through holes 71T2, 108T2, 109T2, 111T2, 112T2, 113T2, 114T2, and 115T2 constituting respective portions of the through hole lines 71T, 108T, 109T, 111T, 112T, 113T, 114T, and 115T. All the through holes in FIG. 25 except the through holes 35T1, 35T2, 108T2, 109T2, 111T2, 112T2, 113T2, 114T2 and 115T2 are the through holes 71T2.

The through holes 34T1, 34T2, 71T1, 108T1, 109T1, 111T1, 1112T1, 113T1, 114T1, and 115T1 shown in FIG. 24 are respectively connected to the through holes 35T1, 35T2, 71T2, 108T2, 109T2, 111T2, 112T2, 113T2, 114T2, and 115T2 formed in the fifth dielectric layer 135. In the dielectric layers 135 to 138, every vertically adjacent through holes denoted by the same reference signs are connected to each other.

Figure 26:
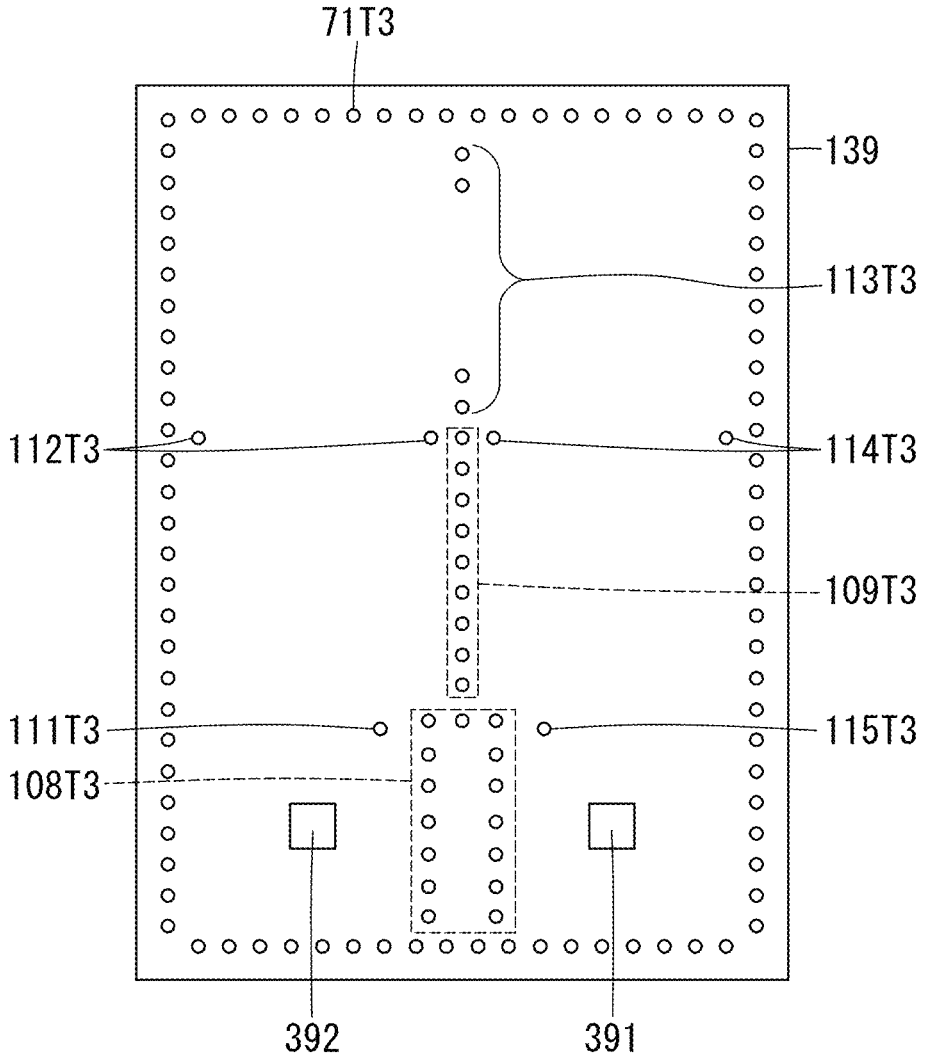
FIG. 26 is a plan view illustrating a patterned surface of a ninth dielectric layer of the peripheral dielectric portion shown in FIG. 19.

FIG. 26 illustrates a patterned surface of the ninth dielectric layer 139. Conductor layers 391 and 392 are formed on the patterned surface of the dielectric layer 139. The through holes 35T1 and 35T2 formed in the eighth dielectric layer 138 are connected to the conductor layers 391 and 392, respectively.

Further formed in the dielectric layer 139 are through holes 71T3, 108T3, 109T3, 111T3, 112T3, 113T3, 114T3, and 115T3 constituting respective portions of the through hole lines 71T, 108T, 109T, 111T, 112T, 113T, 114T, and 115T. All the through holes in FIG. 26 except the through holes 108T3, 109T3, 111T3, 112T3, 113T3, 114T3, and 115T3 are the through holes 71T3.

The through holes 71T2, 108T2, 109T2, 111T2, 112T2, 113T2, 114T2, and 115T2 formed in the eighth dielectric layer 138 are respectively connected to the through holes 71T3, 108T3, 109T3, 111T3, 112T3, 113T3, 114T3, and 115T3 formed in the dielectric layer 139.

Figure 27:
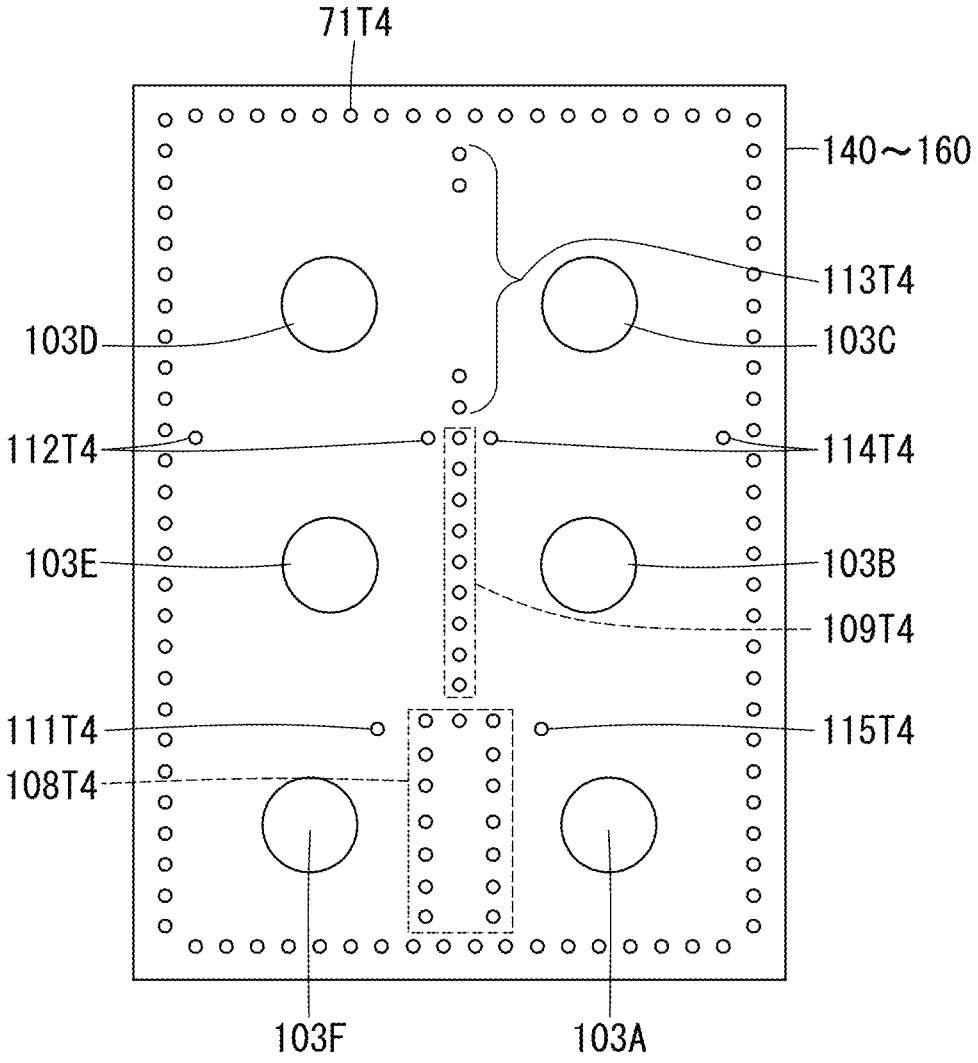
FIG. 27 is a plan view illustrating a patterned surface of each of a tenth to a thirtieth dielectric layer of the peripheral dielectric portion shown in FIG. 19.

FIG. 27 illustrates a patterned surface of each of the tenth to thirtieth dielectric layers 140 to 160. In each of the dielectric layers 140 to 160, there are formed through holes 71T4, 108T4, 109T4, 111T4, 112T4, 113T4, 114T4, and 115T4 constituting respective portions of the through hole lines 71T, 108T, 109T, 111T, 112T, 113T, 114T, and 115T. All the through holes in FIG. 27 except the through holes 108T4, 109T4, 111T4, 112T4, 113T4, 114T4 and 115T4 are the through holes 71T4.

The through holes 71T3, 108T3, 109T3, 111T3, 112T3, 113T3, 114T3, and 115T3 shown in FIG. 26 are respectively connected to the through holes 71T4, 108T4, 109T4, 111T4, 112T4, 113T4, 114T4, and 115T4 formed in the tenth dielectric layer 140. In the dielectric layers 140 to 160, every vertically adjacent through holes denoted by the same reference signs are connected to each other.

The resonator body portions 103A to 103F are provided to penetrate the dielectric layers 140 to 160. The conductor layer 391 shown in FIG. 26 is opposed to the bottom end face of the resonator body portion 103A with the dielectric layer 139 interposed therebetween. The conductor layer 392 shown in FIG. 26 is opposed to the bottom end face of the resonator body portion 103F with the dielectric layer 139 interposed therebetween.

Figure 28:
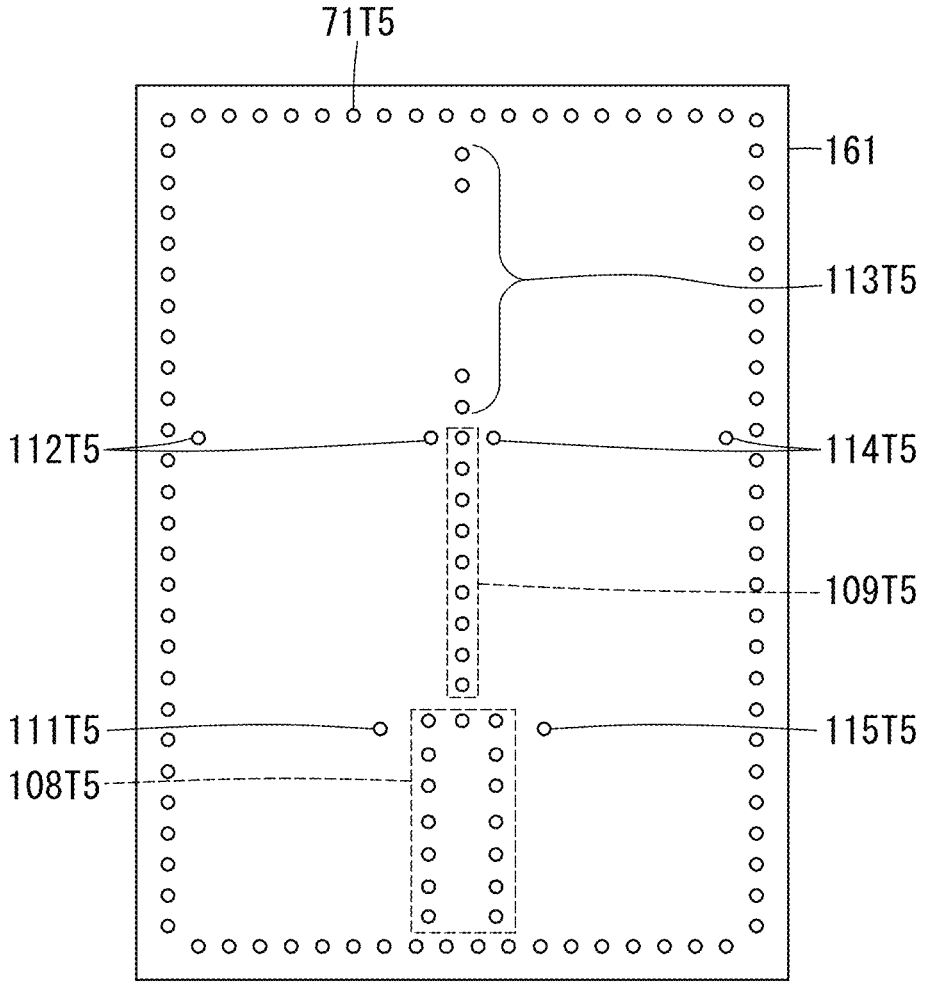
FIG. 28 is a plan view illustrating a patterned surface of a thirty-first dielectric layer of the peripheral dielectric portion shown in FIG. 19.

FIG. 28 illustrates a patterned surface of the thirty-first dielectric layer 161. In the dielectric layer 161, there are formed through holes 71T5, 108T5, 109T5, 111T5, 112T5, 113T5, 114T5, and 115T5 constituting respective portions of the through hole lines 71T, 108T, 109T, 111T, 112T, 113T, 114T, and 115T. All the through holes in FIG. 28 except the through holes 108T5, 109T5, 111T5, 112T5, 113T5, 114T5, and 115T5 are the through holes 71T5.

The through holes 71T4, 108T4, 109T4, 111T4, 112T4, 113T4, 114T4, and 115T4 formed in the thirtieth dielectric layer 160 are respectively connected to the through holes 71T5, 108T5, 109T5, 111T5, 112T5, 113T5, 114T5, and 115T5 formed in the dielectric layer 161.

Figure 29:
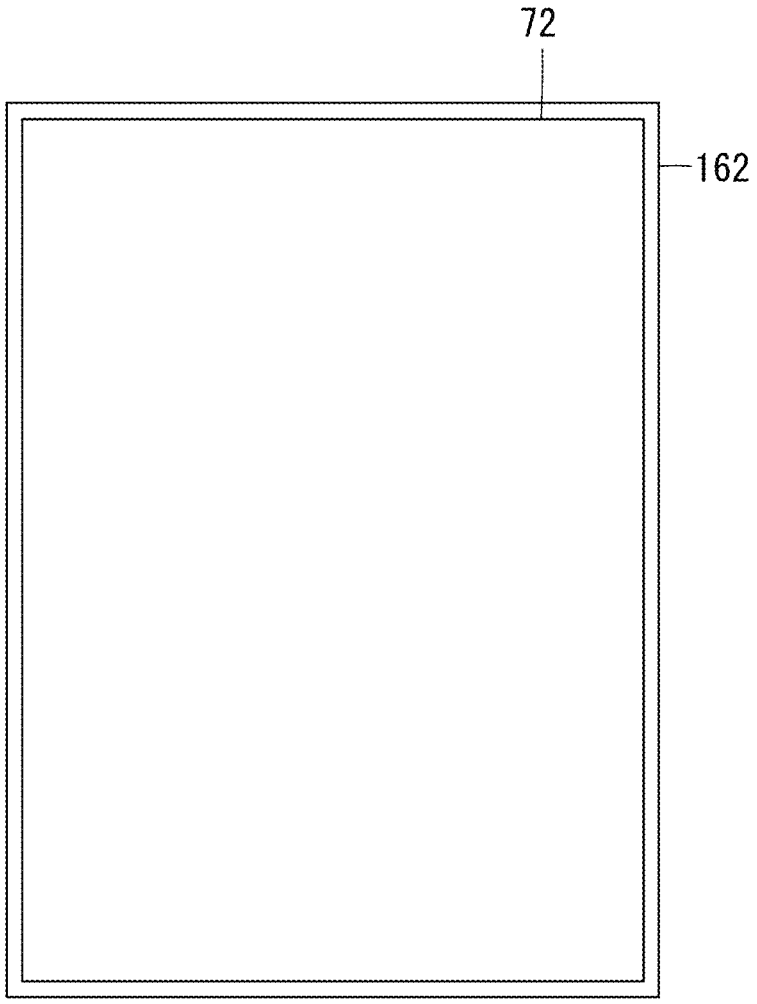
FIG. 29 is a plan view illustrating a patterned surface of a thirty-second dielectric layer of the peripheral dielectric portion shown in FIG. 19.

FIG. 29 illustrates a patterned surface of the thirty-second dielectric layer 162. The shield conductor layer 72 is formed on the patterned surface of the dielectric layer 162. The through holes 71T5, 108T5, 109T5, 111T5, 112T5, 113T5, 114T5, and 115T5 shown in FIG. 28 are connected to the shield conductor layer 72.

The peripheral dielectric portion 4 is formed by stacking the dielectric layers 131 to 162 such that the patterned surface of the dielectric layer 131 shown in FIG. 21 constitutes the bottom surface of the peripheral dielectric portion 4.

The capacitor C10 shown in FIG. 20 is composed of the conductor layer 331 shown in FIG. 23, the conductor layers 321 and 322 shown in FIG. 22, and the dielectric layer 132 interposed between the conductor layer 331 and the conductor layers 321, 322. The capacitor C10 lies in the area between the separation conductor layer 6 and the ground layer 9 within the structure 20. The resonator body portions 103A to 103F lie in the area between the separation conductor layer 6 and the shield conductor layer 72 within the structure 20. The separation conductor layer 6 thus separates the area where the resonator body portions 103A to 103F lie from the area where the capacitor C10 lies.

Some of the plurality of through hole lines 12T constituting the connection portion 12 are arranged to surround the conductor layers 321, 322, and 331 constituting the capacitor C10.

As in the first embodiment, the first phase shifter 11A is composed of the conductor layer 321 and a through hole line constituted of the through holes 32T1, 33T1, 34T1 and 35T1. The second phase shifter 11B is composed of the conductor layer 322 and a through hole line constituted of the through holes 32T2, 33T2, 34T2 and 35T2.

The conductor layer 391 is opposed to the bottom end face of the resonator body portion 103A with the dielectric layer 139 interposed therebetween. The capacitive coupling C11A between the first phase shifter 11A and the first input/output stage resonator 102A is thereby provided. The conductor layer 392 is opposed to the bottom end face of the resonator body portion 103F with the dielectric layer 139 interposed therebetween. The capacitive coupling C11B between the second phase shifter 11B and the second input/output stage resonator 102F is thereby provided.

Figure 30:
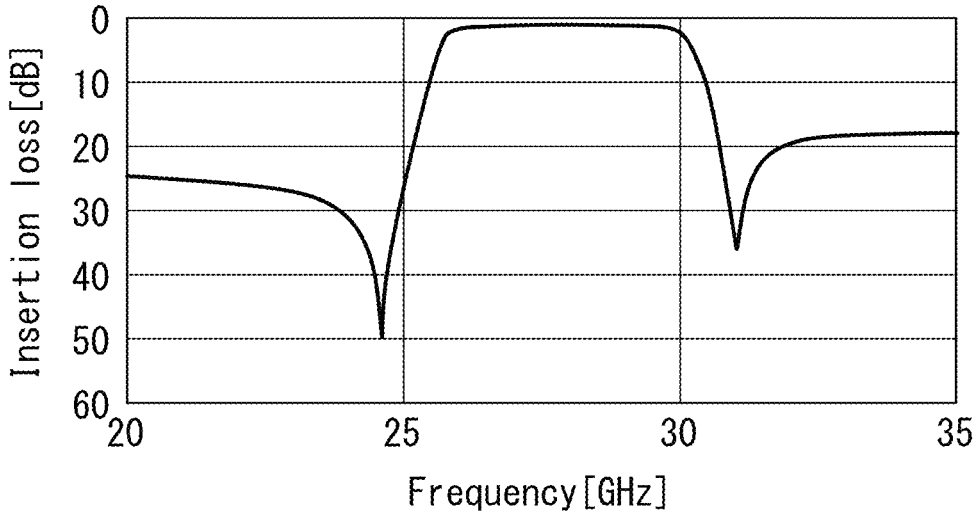
FIG. 30 is a characteristic diagram illustrating an example characteristic of the dielectric filter according to the second embodiment of the invention.

FIG. 30 shows an example of the characteristic of the dielectric filter 101. In FIG. 30, the horizontal axis represents frequency, and the vertical axis represents insertion loss. As shown in FIG. 30, the dielectric filter 101 is able to provide a first attenuation pole in the first passband-neighboring region and a second attenuation pole in the second passband-neighboring region.

The configuration, operation and effects of the present embodiment are otherwise the same as those of the first embodiment.

Third Embodiment

Figure 31:
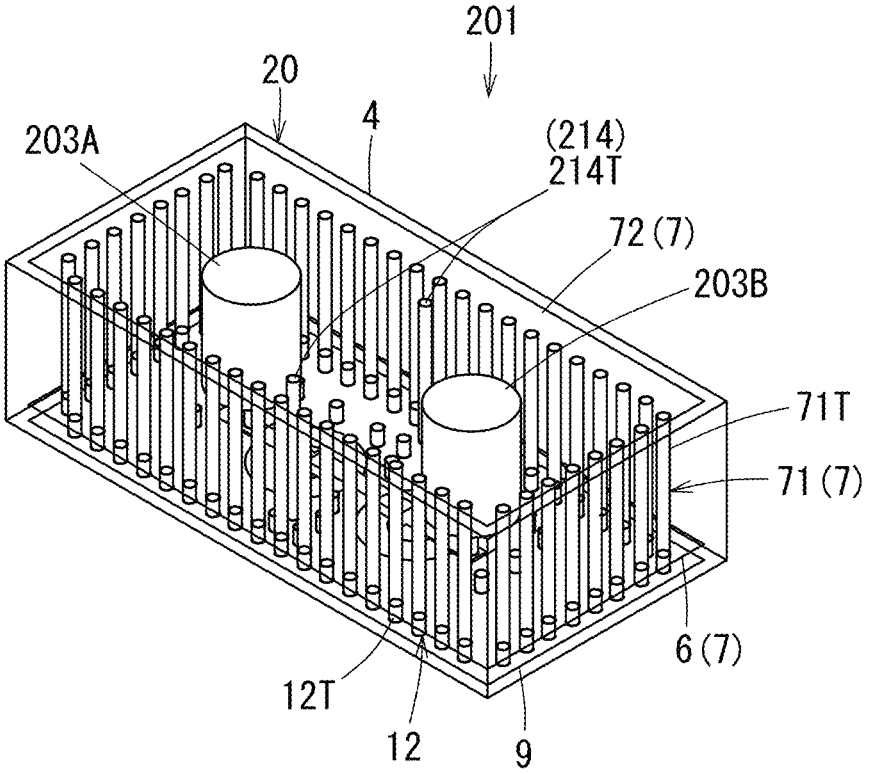
FIG. 31 is a perspective view illustrating the interior of a dielectric filter according to a third embodiment of the invention.
Figure 32:
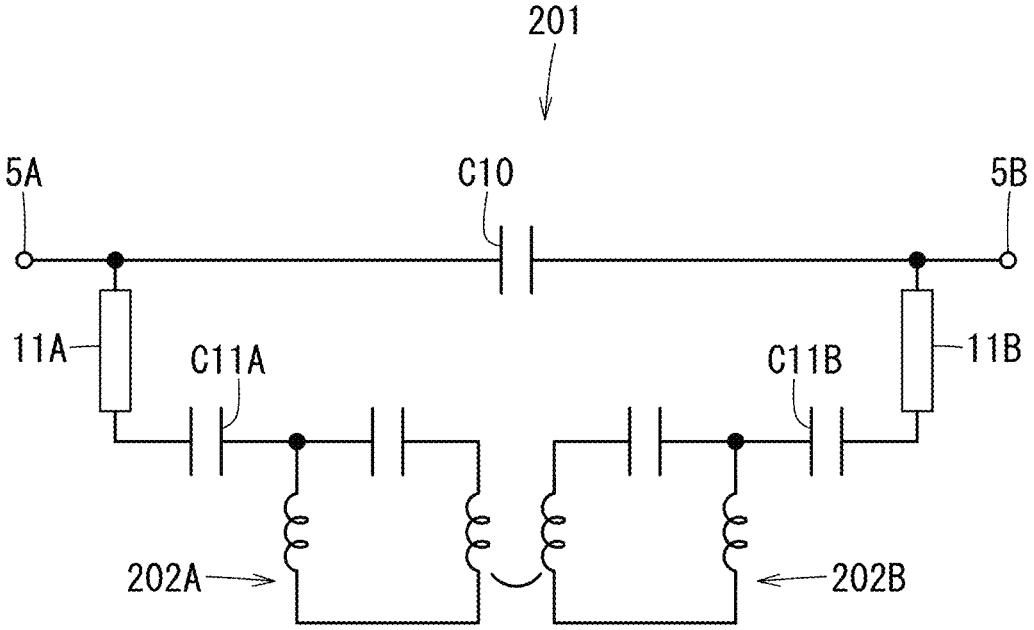
FIG. 32 is a circuit diagram illustrating an equivalent circuit of the dielectric filter according to the third embodiment of the invention.

A third embodiment of the invention will now be described. FIG. 31 is a perspective view illustrating the interior of a dielectric filter according to the third embodiment. FIG. 32 is a circuit diagram illustrating an equivalent circuit of the dielectric filter according to the third embodiment.

As shown in FIG. 32, the dielectric filter 201 according to the present embodiment includes two dielectric resonators 202A and 202B provided between the first input/output port 5A and the second input/output port 5B in circuit configuration, in place of the four dielectric resonators 2A, 2B, 2C, and 2D of the dielectric filter 1 according to the first embodiment.

The dielectric resonators 202A and 202B are arranged in this order, the dielectric resonator 202A being closer to the first input/output port 5A in circuit configuration. The dielectric resonators 202A and 202B are adjacent to each other in circuit configuration and configured to be magnetically coupled to each other. Each of the dielectric resonators 202A and 202B has an inductance and a capacitance.

Hereinafter, the dielectric resonator 202A which is closer to the first input/output port 5A in circuit configuration will also be referred to as the first input/output stage resonator 202A, and the dielectric resonator 202B which is closer to the second input/output port 5B in circuit configuration will also be referred to as the second input/output stage resonator 202B.

In the present embodiment, the first phase shifter 11A is provided between the first input/output port 5A and the first input/output stage resonator 202A in circuit configuration. The first phase shifter 11A is configured to be capacitively coupled to the first input/output stage resonator 202A. In FIG. 32, the capacitor symbol C11A represents the capacitive coupling between the first phase shifter 11A and the first input/output stage resonator 202A.

The second phase shifter 11B is provided between the second input/output port 5B and the second input/output stage resonator 202B in circuit configuration. The second phase shifter 11B is configured to be capacitively coupled to the second input/output stage resonator 202B. In FIG. 32, the capacitor symbol C11B represents the capacitive coupling between the second phase shifter 11B and the second input/output stage resonator 202B.

As shown in FIG. 31, the dielectric filter 201 includes a structure 20 for constructing the first and second input/output ports 5A and 5B, the dielectric resonators 202A and 202B, the capacitor C10 and the first and second phase shifters 11A and 11B.

The structure 20 includes two resonator body portions 203A and 203B corresponding to the two dielectric resonators 202A and 202B, respectively, and a peripheral dielectric portion 4 lying around the two resonator body portions 203A and 203B. Each of the two resonator body portions 203A and 203B is formed of a first dielectric having a first relative permittivity. The peripheral dielectric portion 4 is formed of a second dielectric having a second relative permittivity lower than the first relative permittivity.

The shape and configuration of each of the resonator body portions 203A and 203B are the same as those of one of the resonator body portions 3A to 3D of the first embodiment. The resonator body portions 203A and 203B are configured to be magnetically coupled to each other.

As in the first embodiment, the structure 20 includes a separation conductor layer 6 and a shield portion 7 each formed of a conductor. The separation conductor layer 6 also serves as part of the shield portion 7. The shield portion 7 includes the separation conductor layer 6, a shield conductor layer 72, and a connection portion 71.

The separation conductor layer 6 separates an area where the resonator body portions 203A and 203B lie from an area where the capacitor C10 lies.

The shield portion 7 lies around the resonator body portions 203A and 203B such that at least part of the peripheral dielectric portion 4 is interposed between the shield portion 7 and the resonator body portions 203A, 203B.

The resonator body portions 203A and 203B lie in the area between the separation conductor layer 6 and the shield conductor layer 72 within the structure 20. Each of the resonator body portions 203A and 203B has a top end face closest to the shield conductor layer 72 and a bottom end face closest to the separation conductor layer 6.

The connection portion 71 electrically connects the separation conductor layer 6 and the shield conductor layer 72. The connection portion 71 includes a plurality of through hole lines 71T. The separation conductor layer 6, the shield conductor layer 72 and the connection portion 71 are arranged to surround the resonator body portions 203A and 203B. Each of the resonator body portions 203A and 203B is in non-contact with the shield portion 7.

As shown in FIG. 31, the structure 20 further includes a ground layer 9 and a connection portion 12 each formed of a conductor. The connection portion 12 electrically connects the ground layer 9 and the separation conductor layer 6. The connection portion 12 includes a plurality of through hole lines 12T.

As shown in FIG. 31, the structure 20 further includes a coupling adjustment portion 214 formed of a conductor. The coupling adjustment portion 214 is intended to adjust the magnitude of the magnetic coupling between the resonator body portions 203A and 203B. The coupling adjustment portion 214 electrically connects the separation conductor layer 6 and the shield conductor layer 72. In the example shown in FIG. 31, the coupling adjustment portion 214 includes two through hole lines 214T.

The dielectric resonator 202A is composed of the resonator body portion 203A, at least part of the peripheral dielectric portion 4, and the shield portion 7. The dielectric resonator 202B is composed of the resonator body portion 203B, at least part of the peripheral dielectric portion 4, and the shield portion 7.

The resonance mode of each of the dielectric resonators 202A and 202B is a TM mode. An electromagnetic field generated by the dielectric resonators 202A and 202B is present inside and outside the resonator body portions 203A and 203B. The shield portion 7 has a function of confining the electromagnetic field outside the resonator body portions 203A and 203B to within the area surrounded by the shield portion 7.

Reference is now made to FIGS. 33 to 41 to describe an example of the plurality of dielectric layers constituting the peripheral dielectric portion 4 of the present embodiment and an example of the configurations of a plurality of conductor layers formed on the dielectric layers and a plurality of through holes formed in the dielectric layers. In this example, the peripheral dielectric portion 4 has thirty-two dielectric layers stacked together. The thirty-two dielectric layers will hereinafter be referred to as the first to thirty-second dielectric layers, respectively, in the order from bottom to top. The first to thirty-second dielectric layers will be denoted by the reference numerals 231 to 262, respectively. In FIGS. 33 to 40, each small circle represents a through hole.

Figure 33:
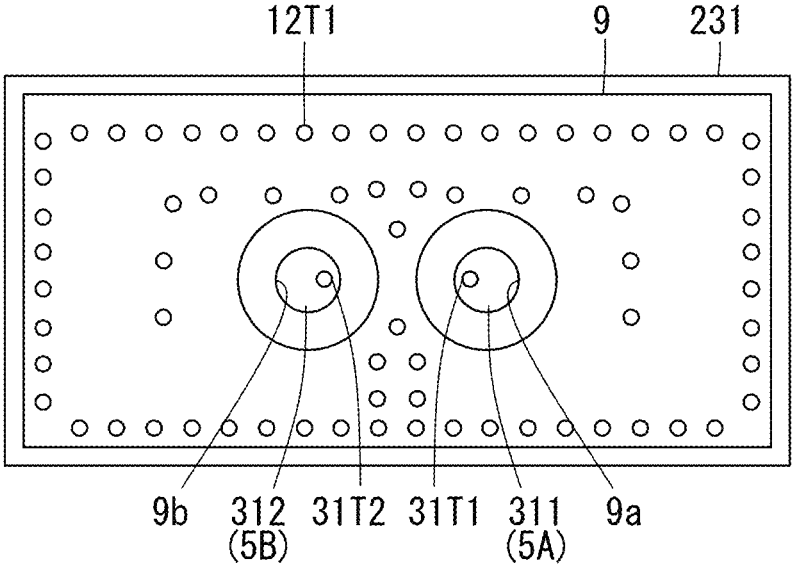
FIG. 33 is a plan view illustrating a patterned surface of a first dielectric layer of a peripheral dielectric portion shown in FIG. 31.

FIG. 33 illustrates a patterned surface of the first dielectric layer 231. On the patterned surface of the dielectric layer 231, there are formed the ground layer 9, a conductor layer 311 forming the first input/output port 5A, and a conductor layer 312 forming the second input/output port 5B. Two circular holes 9*a* and 9*b* are formed in the ground layer 9. The conductor layer 311 lies inside the hole 9*a*, and the conductor layer 312 lies inside the hole 9*b*.

Further, a through hole 31T1 connected to the conductor layer 311, and a through hole 31T2 connected to the conductor layer 312 are formed in the dielectric layer 231. Further formed in the dielectric layer 231 are a plurality of through holes 12T1 constituting respective portions of the plurality of through hole lines 12T. All the through holes in FIG. 33 except the through holes 31T1 and 31T2 are the through holes 12T1. The through holes 12T1 are connected to the ground layer 9.

FIG. 6 illustrates a patterned surface of the second dielectric layer 232. Conductor layers 321 and 322 are formed on the patterned surface of the dielectric layer 232. The shape and location of each of the conductor layers 321 and 322 are the same as those in the first embodiment. The through hole 31T1 shown in FIG. 33 is connected to a portion of the conductor layer 321 near the first end thereof. The through hole 31T2 shown in FIG. 33 is connected to a portion of the conductor layer 322 near the first end thereof.

Further formed in the dielectric layer 232 are a through hole 32T1 connected to a portion of the conductor layer 321 near the second end thereof, and a through hole 32T2 connected to a portion of the conductor layer 322 near the second end thereof. Further formed in the dielectric layer 232 are a plurality of through holes 12T2 constituting respective portions of the plurality of through hole lines 12T. All the through holes in FIG. 34 except the through holes 32T1 and 32T2 are the through holes 12T2. The through holes 12T1 shown in FIG. 33 are respectively connected to the through holes 12T2.

Figure 35:
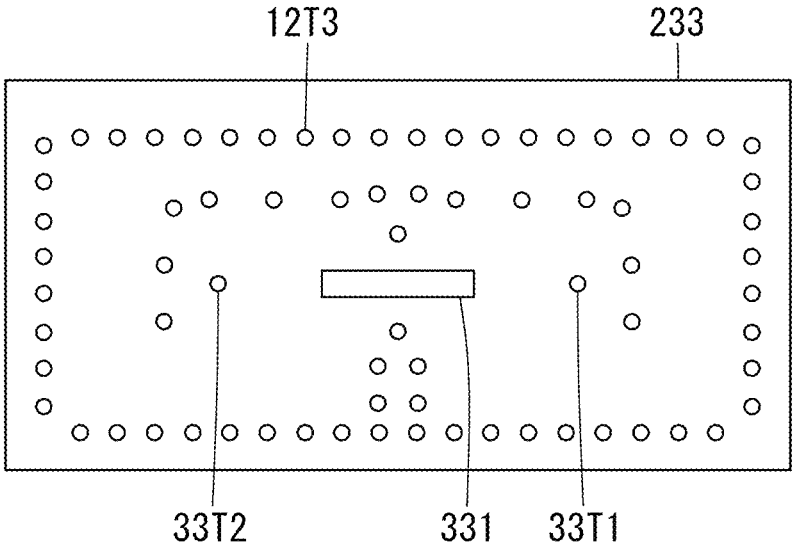
FIG. 35 is a plan view illustrating a patterned surface of a third dielectric layer of the peripheral dielectric portion shown in FIG. 31.

FIG. 35 illustrates a patterned surface of the third dielectric layer 233. A conductor layer 331 long in the X direction is formed on the patterned surface of the dielectric layer 233. A portion of the conductor layer 331 is opposed to the portion of the conductor layer 321 near the first end thereof with the dielectric layer 232 interposed therebetween. Another portion of the conductor layer 331 is opposed to the portion of the conductor layer 322 near the first end thereof with the dielectric layer 232 interposed therebetween.

Figure 34:
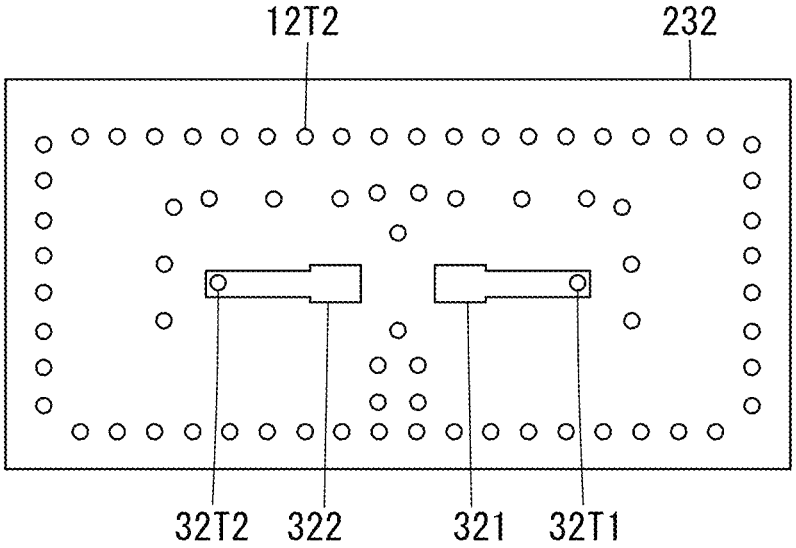
FIG. 34 is a plan view illustrating a patterned surface of a second dielectric layer of the peripheral dielectric portion shown in FIG. 31.

Further formed in the dielectric layer 233 are through holes 33T1 and 33T2, and through holes 12T3 constituting respective portions of the through hole lines 12T. The through holes 32T1 and 32T2 shown in FIG. 34 are connected to the through holes 33T1 and 33T2, respectively. All the through holes in FIG. 35 except the through holes 33T1 and 33T2 are the through holes 12T3. The through holes 12T2 shown in FIG. 34 are respectively connected to the through holes 12T3.

Figure 36:
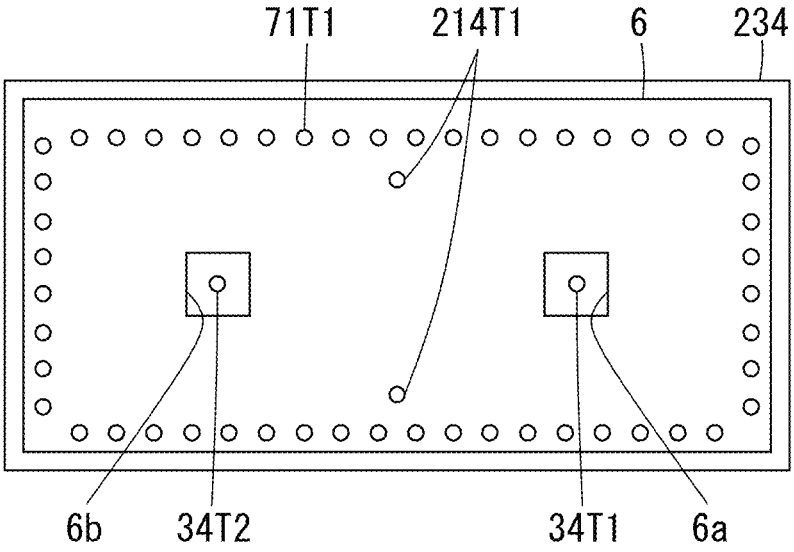
FIG. 36 is a plan view illustrating a patterned surface of a fourth dielectric layer of the peripheral dielectric portion shown in FIG. 31.

FIG. 36 illustrates a patterned surface of the fourth dielectric layer 234. The separation conductor layer 6 is formed on the patterned surface of the dielectric layer 234. Two rectangular holes 6*a* and 6*b* are formed in the separation conductor layer 6.

Through holes 34T1 and 34T2 are formed in the dielectric layer 234. Further formed in the dielectric layer 234 are through holes 71T1 and 214T1 constituting respective portions of the through hole lines 71T and 214T. All the through holes in FIG. 36 except the through holes 34T1, 34T2 and 214T1 are the through holes 71T1.

The through hole 34T1 lies inside the hole 6*a*, and the through hole 34T2 lies inside the hole 6*b*. The through holes 33T1 and 33T2 shown in FIG. 35 are connected to the through holes 34T1 and 34T2, respectively.

In FIG. 36, the through holes 71T1 and 214T1 are connected to the separation conductor layer 6. The separation conductor layer 6 has a rectangular perimeter. The through holes 71T1 are connected to the separation conductor layer 6 at its areas near the perimeter.

Figure 37:
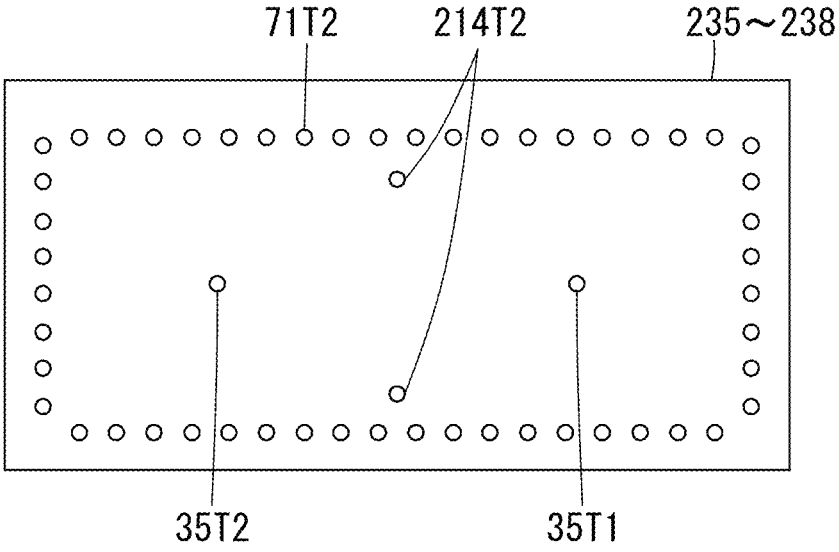
FIG. 37 is a plan view illustrating a patterned surface of each of a fifth to an eighth dielectric layer of the peripheral dielectric portion shown in FIG. 31.

FIG. 37 illustrates a patterned surface of each of the fifth to eighth dielectric layers 235 to 238. Through holes 35T1 and 35T2 are formed in each of the dielectric layers 235 to 238. Further, through holes 71T2 and 214T2 constituting respective portions of the through hole lines 71T and 214T are formed in each of the dielectric layers 235 to 238. All the through holes in FIG. 37 except the through holes 35T1, 35T2 and 214T2 are the through holes 71T2.

The through holes 34T1, 34T2, 71T1, and 214T1 shown in FIG. 36 are respectively connected to the through holes 35T1, 35T2, 71T2, and 214T2 formed in the fifth dielectric layer 235. In the dielectric layers 235 to 238, every vertically adjacent through holes denoted by the same reference signs are connected to each other.

Figure 38:
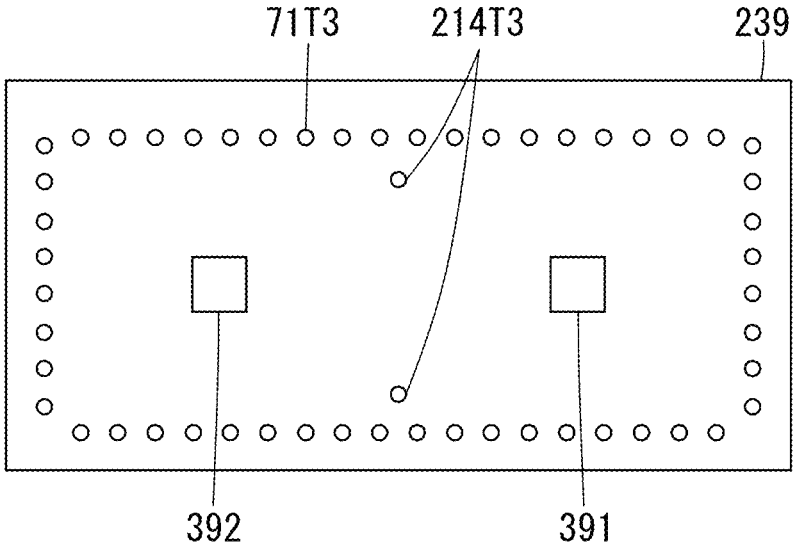
FIG. 38 is a plan view illustrating a patterned surface of a ninth dielectric layer of the peripheral dielectric portion shown in FIG. 31.

FIG. 38 illustrates a patterned surface of the ninth dielectric layer 239. Conductor layers 391 and 392 are formed on the patterned surface of the dielectric layer 239. The through holes 35T1 and 35T2 formed in the eighth dielectric layer 238 are connected to the conductor layers 391 and 392, respectively.

Further, through holes 71T3 and 214T3 constituting respective portions of the through hole lines 71T and 214T are formed in the dielectric layer 239. All the through holes in FIG. 38 except the two through holes 214T3 are the through holes 71T3.

The through holes 71T2 and 214T2 formed in the eighth dielectric layer 238 are respectively connected to the through holes 71T3 and 214T3 formed in the dielectric layer 239.

Figure 39:
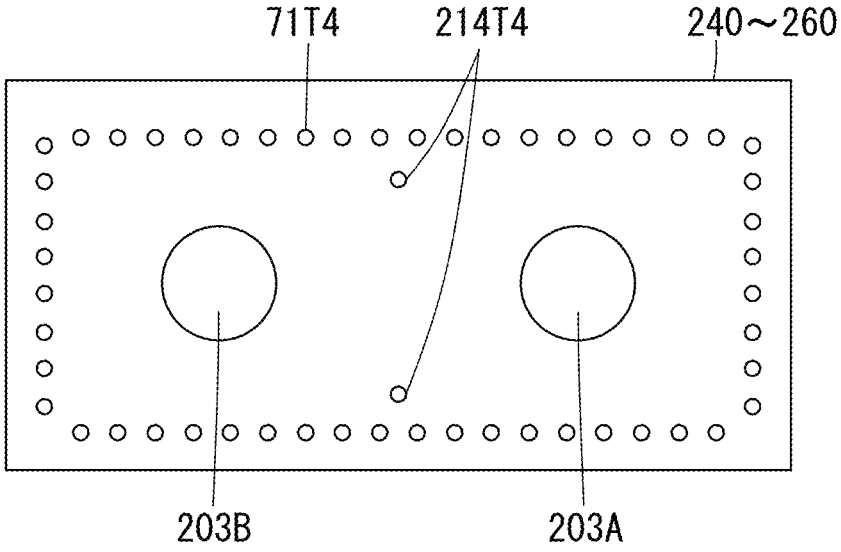
FIG. 39 is a plan view illustrating a patterned surface of each of a tenth to a thirtieth dielectric layer of the peripheral dielectric portion shown in FIG. 31.

FIG. 39 illustrates a patterned surface of each of the tenth to thirtieth dielectric layers 240 to 260. Through holes 71T4 and 214T4 constituting respective portions of the through hole lines 71T and 214T are formed in each of the dielectric layers 240 to 260. All the through holes in FIG. 39 except the two through holes 214T4 are the through holes 71T4.

The through holes 71T3 and 214T3 shown in FIG. 38 are respectively connected to the through holes 71T4 and 214T4 formed in the tenth dielectric layer 240. In the dielectric layers 240 to 260, every vertically adjacent through holes denoted by the same reference signs are connected to each other.

The resonator body portions 203A and 203B are provided to penetrate the dielectric layers 240 to 260. The conductor layer 391 shown in FIG. 38 is opposed to the bottom end face of the resonator body portion 203A with the dielectric layer 239 interposed therebetween. The conductor layer 392 shown in FIG. 38 is opposed to the bottom end face of the resonator body portion 203B with the dielectric layer 239 interposed therebetween.

Figure 40:
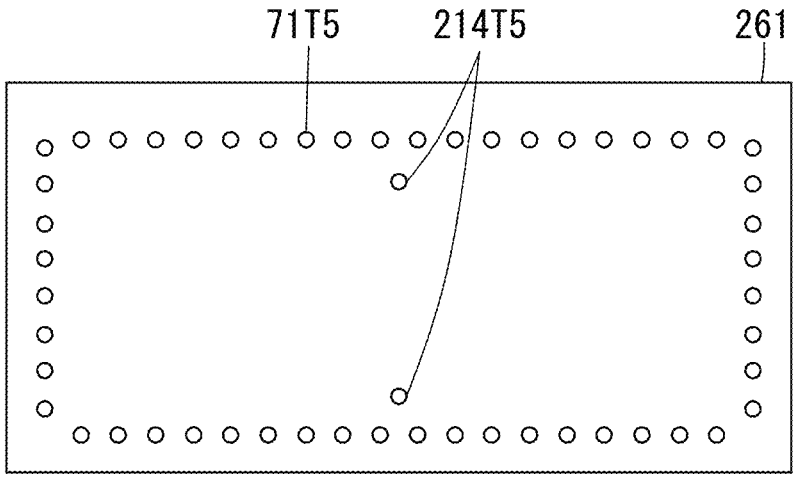
FIG. 40 is a plan view illustrating a patterned surface of a thirty-first dielectric layer of the peripheral dielectric portion shown in FIG. 31.

FIG. 40 illustrates a patterned surface of the thirty-first dielectric layer 361. Through holes 71T5 and 214T5 constituting respective portions of the through hole lines 71T and 214T are formed in the dielectric layer 261. All the through holes in FIG. 40 except the two through holes 214T5 are the through holes 71T5.

The through holes 71T4 and 214T4 formed in the thirtieth dielectric layer 260 are respectively connected to the through holes 71T5 and 214T5 formed in the dielectric layer 261.

Figure 41:
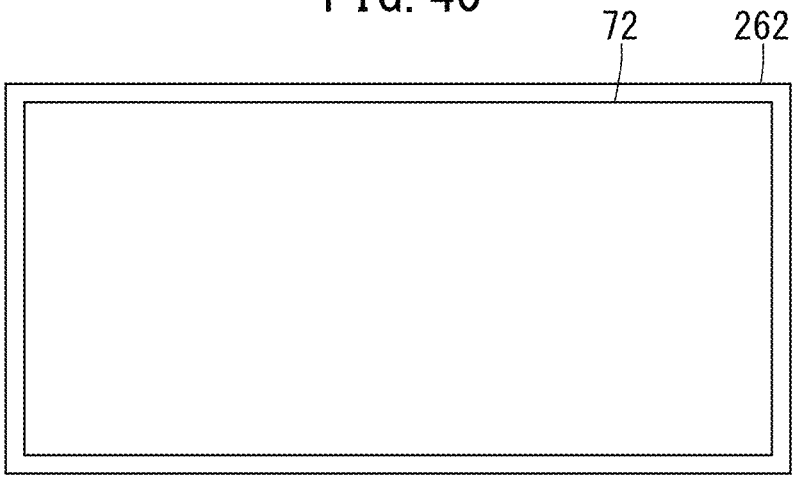
FIG. 41 is a plan view illustrating a patterned surface of a thirty-second dielectric layer of the peripheral dielectric portion shown in FIG. 31.

FIG. 41 illustrates a patterned surface of the thirty-second dielectric layer 262. The shield conductor layer 72 is formed on the patterned surface of the dielectric layer 262. The through holes 71T5 and 214T5 shown in FIG. 40 are connected to the shield conductor layer 72.

The peripheral dielectric portion 4 is formed by stacking the dielectric layers 131 to 162 such that the patterned surface of the dielectric layer 131 shown in FIG. 21 constitutes the bottom surface of the peripheral dielectric portion 4.

The capacitor C10 shown in FIG. 32 is composed of the conductor layer 331 shown in FIG. 35, the conductor layers 321 and 322 shown in FIG. 34, and the dielectric layer 232 interposed between the conductor layer 331 and the conductor layers 321, 322. The capacitor C10 lies in the area between the separation conductor layer 6 and the ground layer 9 within the structure 20. The resonator body portions 203A and 203B lie in the area between the separation conductor layer 6 and the shield conductor layer 72 within the structure 20. The separation conductor layer 6 thus separates the area where the resonator body portions 203A and 203B lie from the area where the capacitor C10 lies.

Some of the plurality of through hole lines 12T constituting the connection portion 12 are arranged to surround the conductor layers 321, 322, and 331 constituting the capacitor C10.

As in the first embodiment, the first phase shifter 11A is composed of the conductor layer 321 and a through hole line constituted of the through holes 32T1, 33T1, 34T1 and 35T1. The second phase shifter 11B is composed of the conductor layer 322 and a through hole line constituted of the through holes 32T2, 33T2, 34T2 and 35T2.

The conductor layer 391 is opposed to the bottom end face of the resonator body portion 203A with the dielectric layer 239 interposed therebetween. The capacitive coupling C11A between the first phase shifter 11A and the first input/output stage resonator 202A is thereby provided. The conductor layer 392 is opposed to the bottom end face of the resonator body portion 203B with the dielectric layer 239 interposed therebetween. The capacitive coupling C11B between the second phase shifter 11B and the second input/output stage resonator 202B is thereby provided.

Figure 42:
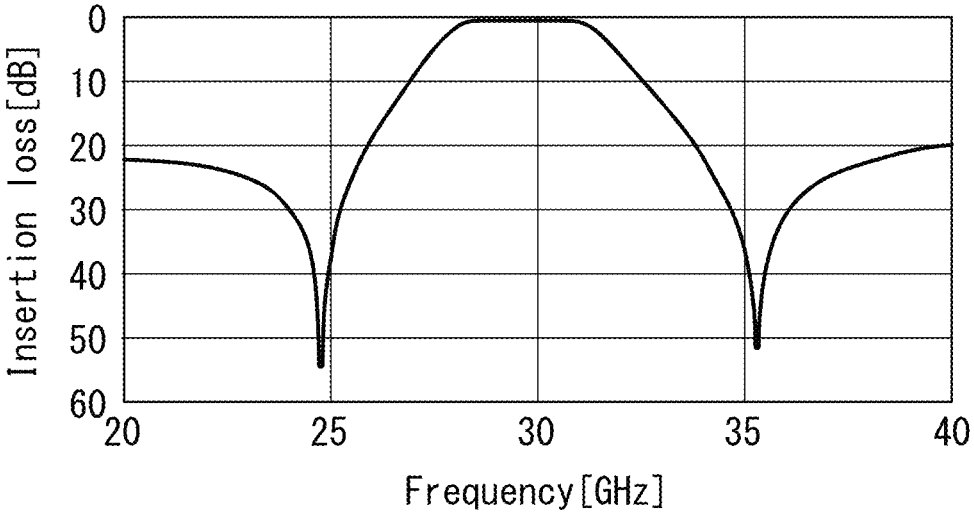
FIG. 42 is a characteristic diagram illustrating an example characteristic of the dielectric filter according to the third embodiment of the invention.

FIG. 42 shows an example of the characteristic of the dielectric filter 201. In FIG. 42, the horizontal axis represents frequency, and the vertical axis represents insertion loss. As shown in FIG. 42, the dielectric filter 201 is able to provide a first attenuation pole in the first passband-neighboring region and a second attenuation pole in the second passband-neighboring region.

The configuration, operation and effects of the present embodiment are otherwise the same as those of the first embodiment.

The present invention is not limited to the foregoing embodiments, and various modifications may be made thereto. For example, in the present invention the number of the dielectric resonators to be provided between the first input/output port and the second input/output port in circuit configuration may be an even number greater than or equal to eight.

Obviously, many modifications and variations of the present invention are possible in the light of the above teachings. Thus, it is to be understood that, within the scope of the appended claims and equivalents thereof, the invention may be practiced in other embodiments than the foregoing most preferable embodiments.

What is claimed is:

1. A dielectric filter comprising:

a first input/output port;

a second input/output port;

an even number of dielectric resonators which are provided between the first input/output port and the second input/output port in circuit configuration and are configured so that two dielectric resonators adjacent to each other in circuit configuration are magnetically coupled to each other; and a capacitor for capacitively coupling the first input/output port and the second input/output port, wherein the even number of dielectric resonators include a first input/output stage resonator which is closest to the first input/output port in circuit configuration, and a second input/output stage resonator which is closest to the second input/output port in circuit configuration, and the dielectric filter further comprising a first phase shifter provided between the first input/output port and the first input/output stage resonator in circuit configuration, and a second phase shifter provided between the second input/output port and the second input/output stage resonator in circuit configuration.

2. The dielectric filter according to claim 1, wherein the first phase shifter is configured to be capacitively coupled to the first input/output stage resonator, and the second phase shifter is configured to be capacitively coupled to the second input/output stage resonator.

3. A dielectric filter comprising:

a first input/output port;

a second input/output port;

an even number of dielectric resonators which are provided between the first input/output port and the second input/output port in circuit configuration and are configured so that two dielectric resonators adjacent to each other in circuit configuration are magnetically coupled to each other;

a capacitor for capacitively coupling the first input/output port and the second input/output port; and a structure for constructing the even number of dielectric resonators and the capacitor, the structure including an even number of resonator body portions corresponding to the even number of dielectric resonators, and a peripheral dielectric portion lying around the even number of resonator body portions, each of the even number of resonator body portions being formed of a first dielectric having a first relative permittivity, the peripheral dielectric portion being formed of a second dielectric having a second relative permittivity lower than the first relative permittivity.

4. The dielectric filter according to claim 3, wherein the structure further includes a separation conductor layer formed of a conductor and separating an area where the even number of resonator body portions lie from an area where the capacitor lies.

5. The dielectric filter according to claim 3, wherein the structure further includes a shield portion formed of a conductor, the shield portion lying around the even number of resonator body portions such that at least part of the peripheral dielectric portion is interposed between the shield portion and the even number of resonator body portions.

6. The dielectric filter according to claim 5, wherein each of the even number of resonator body portions is in non-contact with the shield portion.

7. The dielectric filter according to claim 3, wherein the even number of dielectric resonators include: a first input/output stage resonator which is closest to the first input/output port in circuit configuration; a second input/output stage resonator which is closest to the second input/output port in circuit configuration; and two or more intermediate resonators lying between the first input/output stage resonator and the second input/output stage resonator in circuit configuration, the even number of resonator body portions include: a first input/output stage resonator body portion corresponding to the first input/output stage resonator; a second input/output stage resonator body portion corresponding to the second input/output stage resonator; and two or more intermediate resonator body portions corresponding to the two or more intermediate resonators, and the first input/output stage resonator body portion and the second input/output stage resonator body portion are physically adjacent to each other with none of the two or more intermediate resonator body portions interposed therebetween.

8. The dielectric filter according to claim 7, wherein the structure further includes a partition that is formed of a conductor and arranged to pass between the first and second input/output stage resonator body portions.

* * * * *